US008680461B2

(12) United States Patent
Rardin et al.

(10) Patent No.: US 8,680,461 B2
(45) Date of Patent: Mar. 25, 2014

(54) ANALYTICAL INSTRUMENTATION, APPARATUSES, AND METHODS

(75) Inventors: Brent Rardin, Lafayette, IN (US); James Mitchell Wells, Lafayette, IN (US); Garth E. Patterson, Brookston, IN (US)

(73) Assignee: Griffin Analytical Technologies, L.L.C., West Lafayette, IN (US)

( * ) Notice: Subject to any disclaimer, the term of this patent is extended or adjusted under 35 U.S.C. 154(b) by 576 days.

(21) Appl. No.: 11/919,323

(22) PCT Filed: Apr. 25, 2006

(86) PCT No.: PCT/US2006/015948

§ 371 (c)(1),
(2), (4) Date: Jul. 20, 2009

(87) PCT Pub. No.: WO2006/116564

PCT Pub. Date: Nov. 2, 2006

(65) Prior Publication Data

US 2010/0042334 A1 Feb. 18, 2010

Related U.S. Application Data

(60) Provisional application No. 60/675,340, filed on Apr. 25, 2005.

(51) Int. Cl.
*H01J 49/26* (2006.01)

(52) U.S. Cl.
USPC ..... 250/282; 250/281; 250/288

(58) Field of Classification Search
USPC ..... 250/281, 282, 283, 288, 290, 291, 292, 250/293, 294, 295, 296, 297, 298, 299
See application file for complete search history.

(56) References Cited

U.S. PATENT DOCUMENTS

| | | | |
|---|---|---|---|
| 3,633,173 | A | 1/1972 | Edge |
| 3,984,692 | A | 10/1976 | Arsenault |
| 3,992,632 | A | 11/1976 | Kruger et al. |
| 4,008,388 | A | 2/1977 | McLafferty et al. |
| 4,105,916 | A | 8/1978 | Siegel |
| 4,388,531 | A | 6/1983 | Stafford et al. |
| 4,423,324 | A | 12/1983 | Stafford et al. |
| 4,433,982 | A | 2/1984 | Odernheimer et al. |
| 4,540,884 | A | 9/1985 | Stafford et al. |

(Continued)

FOREIGN PATENT DOCUMENTS

| | | |
|---|---|---|
| CN | 1068656 | 2/1993 |
| DE | 4008388 | 9/1991 |

(Continued)

OTHER PUBLICATIONS de Hoffmann, Edmond, "Tandem Mass Spectrometry: A Primer" Journal of Mass Spectrometry, vol. 31; 1996; pp. 129-137.

(Continued)

*Primary Examiner* — Nicole Ippolito
(74) *Attorney, Agent, or Firm* — Wells St. John P.S.

(57) ABSTRACT

A sample analysis apparatus (10) includes processing circuitry (22) coupled to a data set device (20) and a storage device (24) to acquire one data set from an analysis component (14) according to one analysis parameter set and to prepare another analysis parameter set using another previously acquired data set.

10 Claims, 15 Drawing Sheets

(56) References Cited

U.S. PATENT DOCUMENTS 4,567,897 A 2/1986 Endo et al.
4,644,494 A 2/1987 Muller
4,755,685 A 7/1988 Kawanami et al.
4,757,198 A 7/1988 Korte et al.
4,761,545 A 8/1988 Marshall et al.
4,766,312 A 8/1988 Fergusson et al.
4,771,172 A 9/1988 Weber-Grabau et al.
4,791,292 A 12/1988 Cooks et al.
4,810,882 A 3/1989 Bateman
4,849,628 A 7/1989 McLuckey et al.
4,882,484 A 11/1989 Franzen et al.
4,912,326 A 3/1990 Naito
4,945,236 A 7/1990 Mogami et al.
4,956,788 A 9/1990 Guan et al.
4,988,867 A 1/1991 Laprade
4,991,428 A 2/1991 Heyed
4,996,422 A 2/1991 Mitsui et al.
5,015,848 A 5/1991 Bomse et al.
5,083,021 A 1/1992 Devant et al.
5,083,450 A 1/1992 Grindstaff
5,107,109 A 4/1992 Stafford, Jr. et al.
5,109,691 A 5/1992 Corrigan et al.
5,153,433 A 10/1992 Andersen et al.
5,155,357 A 10/1992 Hemmond
5,202,561 A 4/1993 Giessmann et al.
5,245,192 A 9/1993 Houseman
5,248,882 A 9/1993 Liang
5,304,799 A 4/1994 Kurzweg
5,313,061 A 5/1994 Drew et al.
5,324,939 A 6/1994 Louris et al.
5,345,809 A * 9/1994 Corrigan et al. ..... 73/23.2
5,401,965 A 3/1995 Kaneko et al.
5,420,425 A 5/1995 Bier et al.
5,426,300 A 6/1995 Voss et al.
5,436,447 A 7/1995 Shew
5,448,061 A 9/1995 Wells
5,448,062 A 9/1995 Cooks et al.
5,462,660 A 10/1995 Singleton et al.
5,479,012 A 12/1995 Wells
5,479,747 A 1/1996 Wu
5,481,107 A 1/1996 Takada et al.
5,509,602 A 4/1996 Liu
5,525,799 A 6/1996 Andersen et al.
5,559,325 A 9/1996 Franzen
5,572,022 A 11/1996 Schwartz et al.
5,686,655 A 11/1997 Itoi
5,696,376 A 12/1997 Doroshenko et al.
5,723,862 A 3/1998 Forman
5,760,785 A 6/1998 Barber et al.
5,773,822 A 6/1998 Kitamura et al.
5,777,205 A 7/1998 Nakagawa et al.
5,789,747 A 8/1998 Kato et al.
5,808,308 A 9/1998 Holkeboer
5,818,055 A 10/1998 Franzen
5,837,883 A 11/1998 Itoi
5,844,237 A 12/1998 Whitehouse et al.
5,852,295 A 12/1998 Da Silveira et al.
5,896,196 A 4/1999 Pinnaduwage
6,025,590 A 2/2000 Itoi
6,107,263 A 8/2000 Bateman
6,133,568 A 10/2000 Weiss et al.
6,165,251 A 12/2000 Lemieux et al.
6,215,146 B1 4/2001 Umeda et al.
6,235,197 B1 5/2001 Anderson et al.
6,239,429 B1 5/2001 Blessing et al.
6,253,162 B1 6/2001 Jarman et al.
6,287,988 B1 9/2001 Nagamine et al.
6,329,654 B1 12/2001 Gulcicek et al.
6,351,983 B1 3/2002 Haas et al.
6,410,914 B1 6/2002 Park et al.
6,469,298 B1 10/2002 Ramsey et al.
6,472,661 B1 10/2002 Tanaka et al.
6,472,684 B1 10/2002 Yamazaki et al.
6,476,537 B1 11/2002 Pease et al.
6,487,523 B2 11/2002 Jarman et al.
6,489,610 B1 12/2002 Barofsky et al.
6,489,649 B2 12/2002 Kobayashi et al.
6,496,905 B1 12/2002 Yoshioka et al.
6,507,019 B2 1/2003 Chernushevich et al.
6,509,602 B2 1/2003 Yamazaki et al.
6,530,563 B1 3/2003 Miller et al.
6,541,765 B1 4/2003 Vestal
6,541,768 B2 4/2003 Andrien et al.
6,549,861 B1 4/2003 Mark et al.
6,559,443 B2 5/2003 Shiokawa et al.
6,570,151 B1 5/2003 Grosshans et al.
6,577,531 B2 6/2003 Kato
6,586,727 B2 7/2003 Bateman et al.
6,593,568 B1 7/2003 Whitehouse et al.
6,596,585 B2 7/2003 Kobayashi et al.
6,596,989 B2 7/2003 Kato
6,621,077 B1 9/2003 Guevremont et al.
6,646,254 B2 11/2003 Tanaka
6,649,129 B1 11/2003 Neal
6,677,582 B2 1/2004 Yamada et al.
6,679,093 B2 1/2004 Johnson et al.
6,686,592 B1 2/2004 Sakairi et al.
6,710,336 B2 3/2004 Wells
6,717,130 B2 4/2004 Bateman et al.
6,737,644 B2 5/2004 Itoi
6,744,045 B2 6/2004 Fries et al.
6,750,449 B2 6/2004 Marcus
6,753,523 B1 6/2004 Whitehouse et al.
6,756,640 B2 6/2004 Yamazaki et al.
6,759,652 B2 7/2004 Yoshinari et al.
6,759,706 B2 7/2004 Kobayashi
6,762,406 B2 7/2004 Cooks et al.
6,764,902 B2 7/2004 Kobayashi et al.
6,815,673 B2 11/2004 Plomley et al.
6,825,466 B2 11/2004 Mordekhay
6,835,927 B2 12/2004 Becker et al.
6,861,650 B2 3/2005 Kondo et al.
6,888,130 B1 5/2005 Gonin
6,902,937 B2 6/2005 Vanatta
6,906,322 B2 6/2005 Berggren et al.
6,939,718 B2 9/2005 Singh et al.
7,015,466 B2 3/2006 Takats et al.
7,026,177 B2 4/2006 Laprade
7,045,776 B2 5/2006 Kaufman et al.
7,047,144 B2 5/2006 Steiner
7,129,481 B2 10/2006 Overney
7,138,626 B1 11/2006 Karpetsky
7,230,601 B2 6/2007 Yamazaki et al.
7,294,832 B2 11/2007 Wells et al.
7,339,820 B2 3/2008 Kato
7,355,169 B2 4/2008 McLuckey et al.
7,388,197 B2 6/2008 McLean et al.
7,399,415 B2 7/2008 Srinivasan et al.
7,427,750 B2 9/2008 Grossenbacher
7,439,121 B2 10/2008 Ohmi et al.
7,449,170 B2 11/2008 Regnier et al.
7,462,821 B2 12/2008 Barket, Jr. et al.
7,735,352 B2 6/2010 Alm et al.
2002/0005479 A1 1/2002 Yoshinari et al.
2002/0113268 A1 8/2002 Koyama et al.
2002/0195556 A1 12/2002 Yoshinari et al.
2003/0113936 A1 6/2003 Yamamoto
2004/0172200 A1* 9/2004 Kearney et al. ..... 702/19
2005/0272168 A1* 12/2005 Zhang et al. ..... 436/173
2006/0016979 A1* 1/2006 Yang et al. ..... 250/288
2006/0231769 A1 10/2006 Stresau et al.
2006/0243901 A1 11/2006 Barket, Jr. et al.
2006/0255258 A1 11/2006 Wang et al.
2007/0162232 A1 7/2007 Patterson
2007/0213940 A1 9/2007 Rardin

FOREIGN PATENT DOCUMENTS

EP 0 336 990 A1 10/1989
EP 047506803 4/2008
GB 2 026 231 8/1979
GB 2 363 249 A 12/2001
GB 2406434 A 3/2005
JP 63318061 12/1988

(56) References Cited

FOREIGN PATENT DOCUMENTS

| | | |
|---|---|---|
| JP | 11 073911 A | 3/1999 |
| JP | 2000314724 | 11/2000 |
| WO | WO 01/22079 | 3/2001 |
| WO | WO 01/93307 | 12/2001 |
| WO | WO 2004/097352 | 11/2004 |
| WO | PCT/US06/15948 | 4/2006 |
| WO | PCT/US2006/015948 | 4/2006 |

OTHER PUBLICATIONS

Jardine et al.; "A Tandem Time-of-Flight Mass Spectrometer" Organic Mass Spectrometry vol. 27; 1992; pp. 1077-1083.
Schwartz et al., "A Two-Dimensional Quadrupole Ion Trap Mass Spectrometer", Am. Society for Mass Spectrometry, 2002 , pp. 659-669.
EP 03 81 2512Sup Search Report, Jan. 26, 2007, Griffin Analytical Tech.
WO PCT/US03/38587 Search Report, Aug. 10, 2004, Griffin Analytical Tech.
WO PCT/US04/001144 IPRP, Jul. 22, 2005, Griffin Analytical Tech.
WO PCT/US04/001144 Search Report, Apr. 6, 2005, Griffin Analytical Tech.
WO PCT/US04/001144 Written Opinion, Apr. 6, 2005, Griffin Analytical Tech.
WO PCT/US04/12849 IPRP, Oct. 28, 2005, Griffin Analytical Tech.
WO PCT/US04/12849 Search Report, Jun. 23, 2005, Griffin Analytical Tech.
WO PCT/US04/12849 Written Opinion, Jun. 23, 2005, Griffin Analytical Tech.
WO PCT/US04/29028 IPRP, Feb. 28, 2007, Griffin Analytical Tech.
WO PCT/US04/29028 Search Report, Jan. 26, 2007, Griffin Analytical Tech.
WO PCT/US04/29028 Written Opinion, Jan. 26, 2007, Griffin Analytical Tech.
WO PCT/US04/29029 IPRP, Mar. 16, 2006, Griffin Analytical Tech.
WO PCT/US04/29029 Search Report, Sep. 9, 2005, Griffin Analytical Tech.
WO PCT/US04/29029 Written Opinion, Sep. 9, 2005, Griffin Analytical Tech.
WO PCT/US04/29127, IPRP, Mar. 6, 2006, Griffin Analytical Tech.
WO PCT/US04/29127 Search Report, Jul. 18 2005, Griffin Analytical Tech.
WO PCT/US04/29127 Written Opinion, Jul. 18 2005, Griffin Analytical Tech.
WO PCT/US05/020783 IPRP, Dec. 20, 2006, Griffin Analytical Tech.
WO PCT/US05/020783 Search Report, Dec. 16, 2005, Griffin Analytical Tech.
WO PCT/US05/020783 Written Opinion, Dec. 16, 2005, Griffin Analytical Tech.
Badman, Ethan R., and Coks, R. Graham, "Cylindrical Ion Trap Array with Mass Selection by Variation in Trap Dimensions" Anal. Chem. 2000, 72, pp. 5079-5096.
Barlow, et al., "Determination of Analytic Potentials from Finite Element Computations" Int. Journal of Mass Spectrometry, Apr. 12, 2001, pp. 19-29.
Bollen et al., "ISOLTRAP: A Tandem Penning Trap System for Accurate On-line Mass Determination of Short-lived Isotopes" Nuclear Instruments & Methods in Physics Research, Jan. 11, 1996, pp. 675-697.
Camel, V. and Caude, M., "Trace Enrichment Methods for the Determination of Organic Pollutants in Ambient Air" J. Chrom. A., 710 (1995) p. 3-19.
Carroll et al.; "A Dual Vacuum chamber Fourier Transform Mass Spectrometer with Rapidly Interchangeable LSIMS and MALDI" Analytical Chemistry vol. 78 No. 10, May 15, 1996.
Groves, David. "Field Portable MS for Explosive Detection" 4th Harsh Environments Spectrometry Workshop, Oct. 9, 2003, all slides.
Johnson et al.; "Membrane Introduction Mass Spectrometry: Trends and Applications" Mass Spectrometry Reviews (2000) 19, pp. 1-37.
Louris et al., "Instrumentation, Applications, and Energy Deposition in Quadrupole Ion-Trap Tandem Mass Spectrometry" Anal. Chem., 1987, 59, pp. 1677-1685.
McLuckey et al.; "High Explosives Vapor Detection by Glow Discharge—Ion Trap Mass Spectrometry" Rapid Communications in Mass Spectrometry vol. 10 (1996) pp. 287-298.
Ojala, Marja, "Novel Membrane Inlet Mass Spectrometic Methods for Analysis of Organic Compounds in Aqueous and Solid Samples" VTT Publications Technical Research Centre of Finland Espoo 2001.
Vestal, Marvin L.; "Methods of Ion Generation" Chem. Rev. 2001, 101(2); pp. 361-375.
Wells, et al., "A Quadrupole Ion Trap with Cylindrical Geometry Operated in the Mass-Selective Instability Mode" Anal. Chem., 1998, 70, pp. 438-444.

* cited by examiner

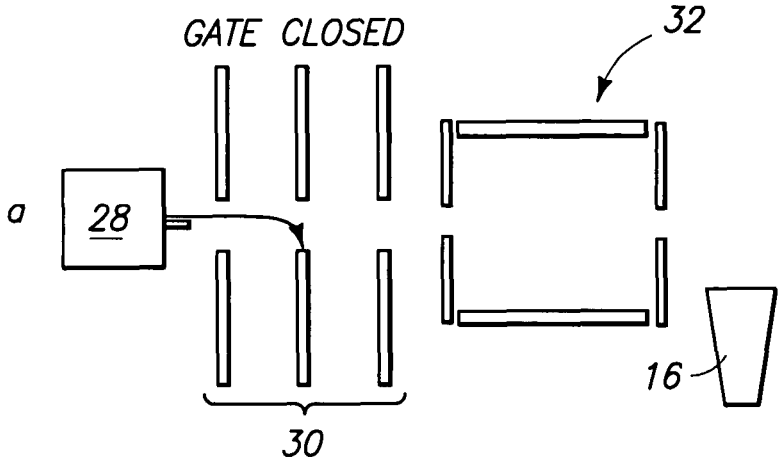
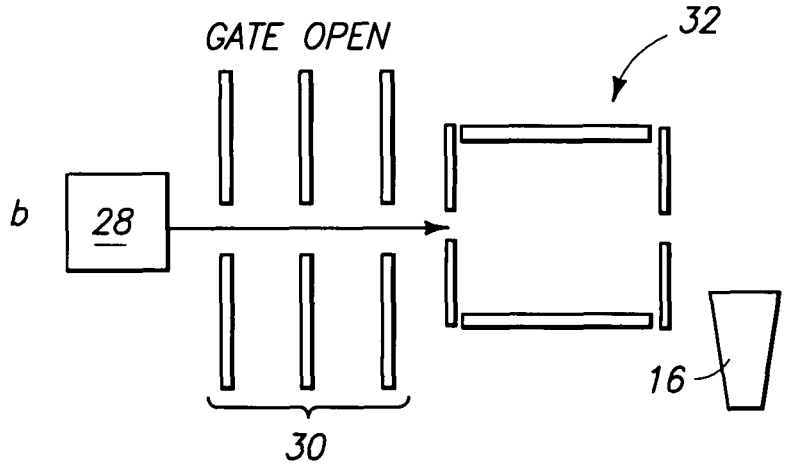
Fig 4

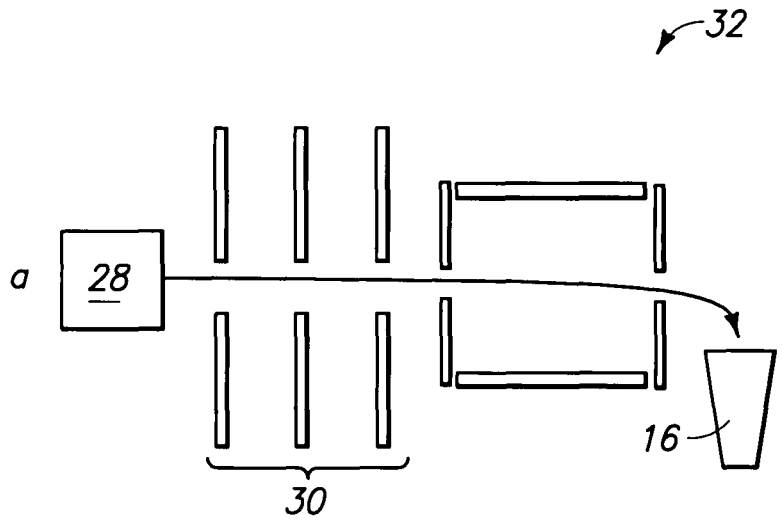
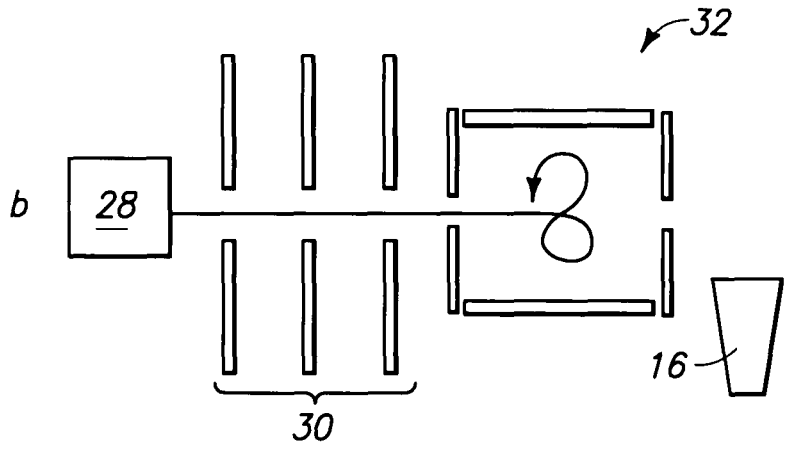
Fig 5

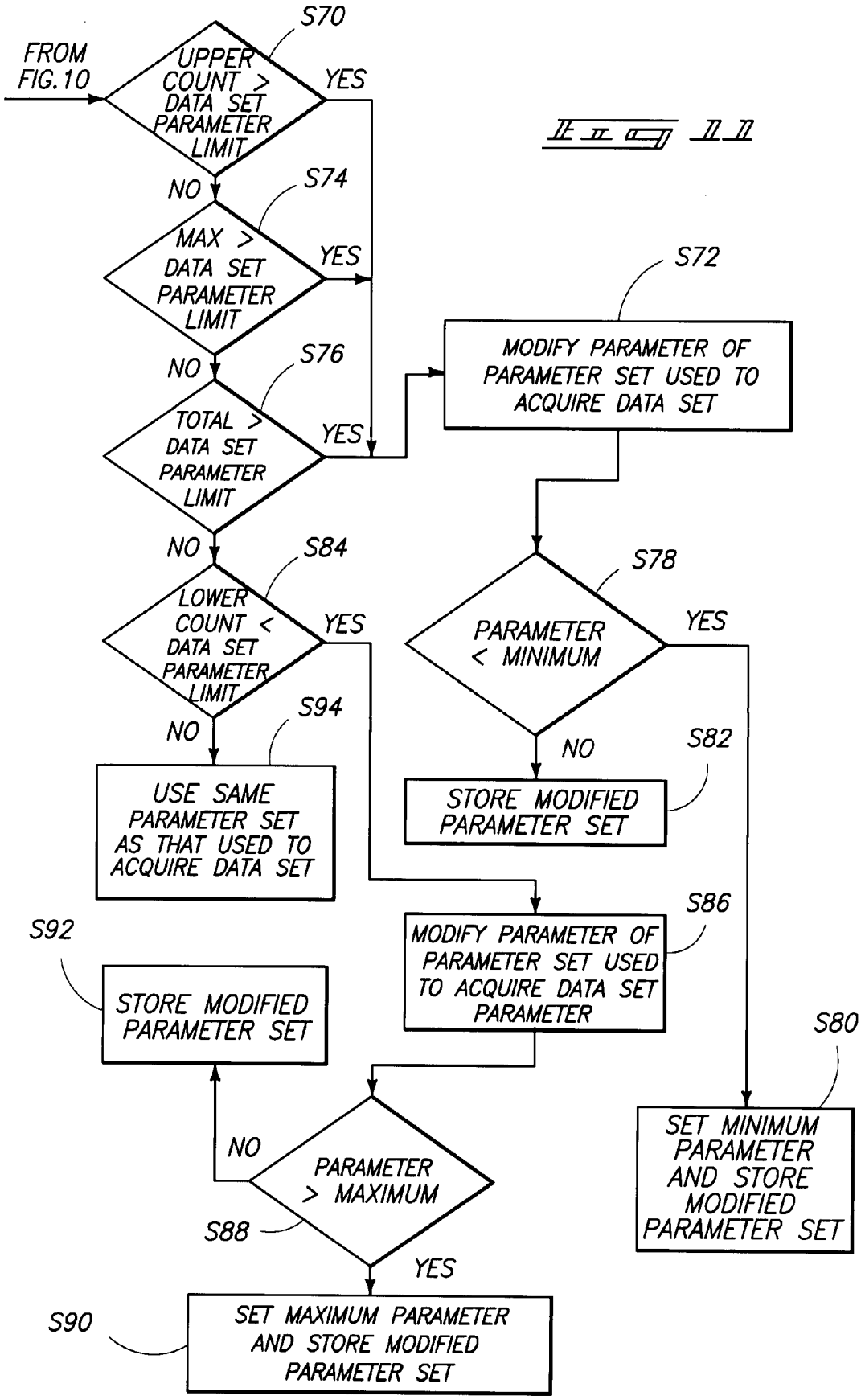
FIG. 11
FROM FIG. 10
S70
UPPER COUNT > DATA SET PARAMETER LIMIT
YES
NO
S74
MAX > DATA SET PARAMETER LIMIT
YES
NO
S76
TOTAL > DATA SET PARAMETER LIMIT
YES
NO
S84
LOWER COUNT < DATA SET PARAMETER LIMIT
YES
NO
S94
USE SAME PARAMETER SET AS THAT USED TO ACQUIRE DATA SET
S72
MODIFY PARAMETER OF PARAMETER SET USED TO ACQUIRE DATA SET
S78
PARAMETER < MINIMUM
YES
NO
S82
STORE MODIFIED PARAMETER SET
S86
MODIFY PARAMETER OF PARAMETER SET USED TO ACQUIRE DATA SET PARAMETER
S92
STORE MODIFIED PARAMETER SET
S80
SET MINIMUM PARAMETER AND STORE MODIFIED PARAMETER SET
NO
PARAMETER > MAXIMUM
S88
YES
S90
SET MAXIMUM PARAMETER AND STORE MODIFIED PARAMETER SET

ANALYTICAL INSTRUMENTATION, APPARATUSES, AND METHODS

RELATED PATENT DATA

This application is a 35 U.S.C. §371 of and claims priority to PCT International Application Number PCT/US2006/015948, which was filed 25 Apr., 2006 (Apr. 25, 2006) and was published in English, which claims priority under 35 U.S.C. §119 to U.S. Provisional Patent Application No. 60/675,340 which was filed 25 Apr., 2005, the entirety of each are incorporated herein by reference.

GOVERNMENT RIGHTS STATEMENT

This invention was made with Government support under SBIR Phase-II Contract M67004-04-C-0014 awarded by the United States Marine Corps. The Government has certain rights in the invention.

TECHNICAL FIELD

The present disclosure relates to analytical instrumentation, apparatuses and methods. More specific embodiments include mass spectrometry instrumentation, apparatuses, and methods.

BACKGROUND

Present day analytical instrumentation typically includes an analyte preparation component and a detection component coupled to a processing and control component. The processing and control component typically takes the form of a computer that is configured to control analysis by providing parameters to the analyte preparation and/or the detection components. For example, in the case of mass spectrometry instrumentation, the processing and control component may provide a detection parameter to the detection component, such as a voltage to the electron multiplier and/or engagement of the electron multiplier in the on or off stage. Likewise, the processing and control component may also provide analytical preparation component parameters in the form of ionization energies, ionization times, scan range, and/or waveforms. Typically these parameters are downloaded to these components by the processing and control component and data sets are acquired utilizing these parameters. Upon interpretation of the acquired data sets, the operator of the instrument may feel it is necessary to redefine certain parameters, download these parameters, and acquire additional sets of data.

The present invention provides analytical instruments and analytical processes that provide, in certain embodiments, dynamic modification of analytical component parameters during analysis.

SUMMARY

Sample analysis apparatuses are disclosed that can include processing circuitry configured to acquire one data set from an analysis component configured according to one analysis parameter set, and prepare another analysis parameter set using another previously acquired data set.

Sample analysis methods are disclosed that can include acquiring first and second data sets from an analysis component configured according to a first analysis component parameter set provided to the analysis component from a process and control component coupled to the analysis component. Sample analysis methods can also include using the process and control component to process the first data set to prepare a second analysis component parameter set.

Sample analysis instruments are disclosed that can include a processing and control component coupled to an analysis component with the processing and control component comprising processing circuitry coupled to a storage device. The storage device of the instrument can also include analysis component parameter sets associated with data parameter values with individual ones of the analysis component parameter sets being associated with individual ones of the data parameter values. The processing circuitry of the instrument can be configured to process data sets and select an analysis component parameter set from the storage device using a data parameter of the data sets.

DESCRIPTION OF THE DRAWINGS

Embodiments of the disclosure are described below with reference to the following accompanying drawings.

FIG. 4 depicts mass spectrometry instruments configured according to aspects of the present disclosure.

FIG. 5 depicts mass spectrometry instruments configured according to aspects of the present disclosure.

FIG. 7 is a block diagram of an instrument according to the present disclosure.

FIG. 15 depicts analysis component parameter set configurations according to the present disclosure.

DETAILED DESCRIPTION

Embodiments of the analytical apparatuses, instrumentation and methods are described with reference to FIGS. 1-15.

Figure 1:
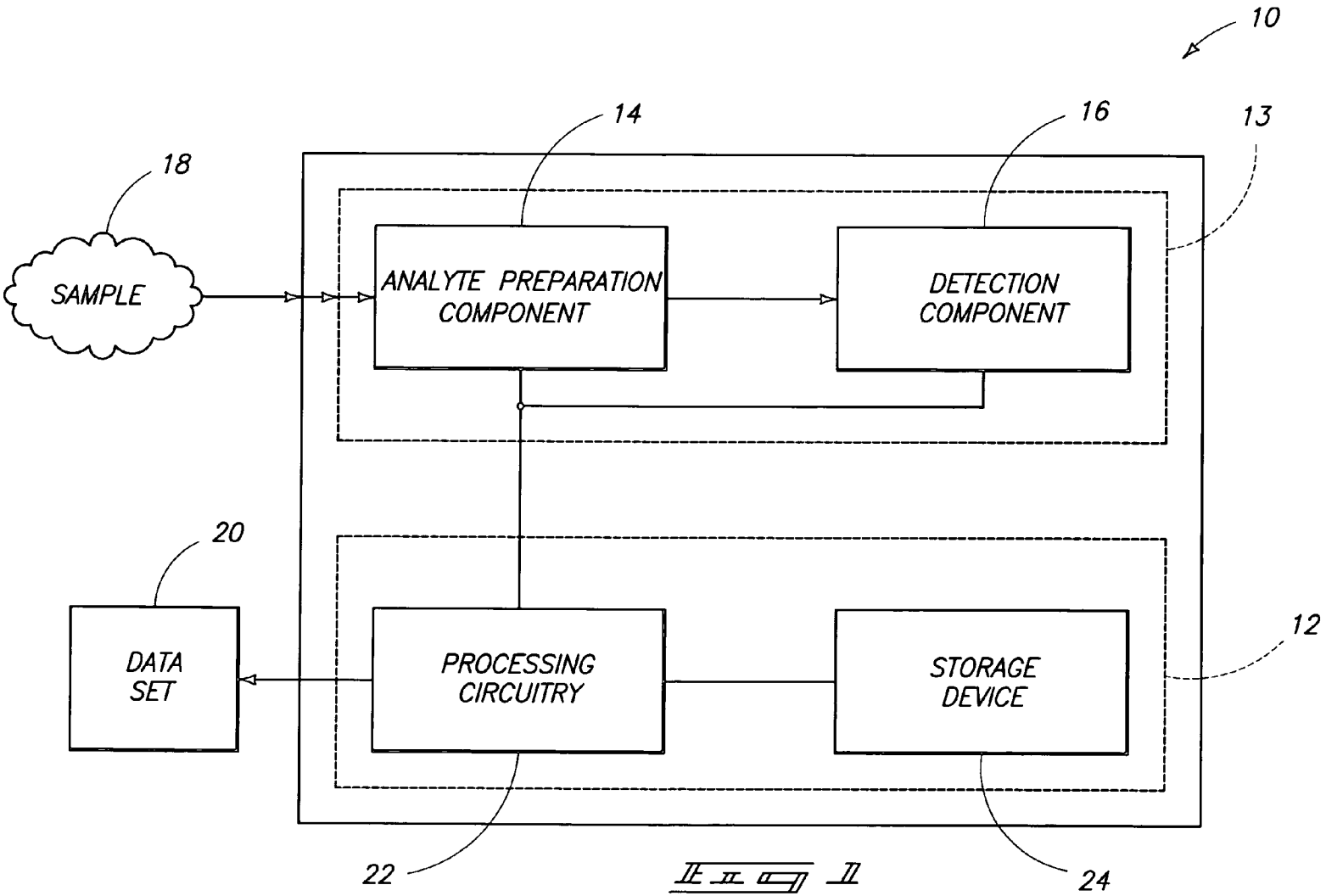
FIG. 1 is an analytical instrument according to an embodiment.

Referring first to FIG. 1, instrument 10 is shown that includes processing and control component 12 coupled to analysis component 13. Instrument 10 can be configured to receive a sample 18 for analysis and provide a data set 20 upon analysis of sample 18, for example.

Sample 18 can be any known and/or unknown chemical composition. For example, sample 18 can be any chemical composition including both inorganic and organic substances in solid, liquid and/or vapor form. Specific examples of sample 18 suitable for analysis in accordance with the present invention include volatile compounds, such as toluene, or specific examples include highly-complex non-volatile protein based structures, such as bradykinin. In certain aspects, sample 18 can be a mixture containing more than one substance or in other aspects sample 18 can be a substantially pure substance.

Instrument 10 can be any instrument configured with a processing and control component 12 and an analysis component 13. This includes analytical apparatuses used for chemical analysis such gas or liquid chromatographs equipped with detectors such as flame ionization, UV-vis, conductivity, IR, and/or mass spectrometry detectors. Instrument 10 can be configured as described in U.S. patent application Ser. No. 10/542,817 entitled Mass Spectrometer Assemblies, Mass Spectrometry Vacuum Chamber Lid Assemblies, and Mass Spectrometer Operational Methods filed Jul. 13, 2005, the entirety of which is incorporated by reference herein. Instrument 10 can also be configured as described in U.S. patent application Ser. No. 10/554,039 entitled Mass Spectrometry Instruments and Methods, filed Oct. 20, 2005, the entirety of which is incorporated by reference herein. As another example, instrument 10 can be configured as described in International Patent Application Serial No. PCT/US05/20783 entitled Analytical Instruments, Assemblies, and Methods, filed Jun. 13, 2005, the entirety of which is incorporated by reference herein. Instrument 10 can include an analysis component 13 coupled to a processing and control component 12.

Analysis component 13 includes a detection component 16 coupled to the processing and control component. Detection component 16 can include a mass spectrometer, a flame ionization detector, a thermal conductivity detector, a thermal ionic detector, an electron capture detector, or an atomic emission detector. Furthermore, detection component 16 can include an absorbance detector such as an ultraviolet absorbance detector, a fluorescence detector, an electrochemical detector, a refractive index detector, a conductivity detector, a fourier transform infrared spectrometer, a light scattering detector, a photo ionization detector, and/or a diode array detector. Detection component 16 can be an atomic spectroscopy detector, an emission spectroscopy detector, or a nuclear magnetic resonance spectroscopy detector. Exemplary detection components include those described in U.S. patent application Ser. No. 10/537,019 entitled Processes for Designing Mass Separators and Ion Traps, Methods for Producing Mass Separators and Ion Traps, Mass Spectrometers, Ion Traps, and Methods for Analyzing Samples, the entirety of which is incorporated by reference herein. Additional detection components include those described in International Patent Serial No. PCT/US04/29127 entitled Ion Detection Methods, Mass Spectrometry Analysis Methods, and Mass Spectrometry Instrument Circuitry, filed Sep. 3, 2004, the entirety of which is incorporated by reference herein.

Analysis component 13 can also include an analyte preparation component 14, if desired. Analyte preparation component 14 can include chromatography, derivatization, and/or purge and trap components, for example. Exemplary analyte preparation components include those described in U.S. patent application Ser. No. 11/173,263 entitled Spectrometry Instruments, Assemblies and Methods, filed Jun. 30, 2005, the entirety of which is incorporated by reference herein. Analysis component 13 can also be configured as described in U.S. patent application Ser. No. 11/152,395 entitled Instrument Assemblies and Analysis Methods, filed Jun. 13, 2005, as well as described in U.S. Provisional Patent Application Ser. No. 60/681,188 entitled Analytical Instrumentation and Processes, filed May 13, 2005, the entirety of both of which are incorporated by reference herein.

Analysis component 13 can include those analytical components that can be configured according to analysis parameters. According to exemplary embodiments, analysis component 13 can be configured according to analysis parameter sets. For example where analyte preparation component 14 is a gas chromatograph component, the gas chromatograph component is configured according to an analysis parameter set that can include parameters such as injector temperature, oven program, and/or split/splitless relay times. As another example, where analyte preparation component 14 is a liquid chromatograph component, the liquid chromatograph component is configured according to an analysis parameter set that can include parameters such as sample volume and liquid phase composition program.

As another example, analysis component 13 can include detection component 16 that can be configured according to analysis parameter sets. For example and by way of example only, detection component 16 can be a mass spectrometry detector component that includes an ionization component coupled to an ion trap and a detector. The mass spectrometry detector component can be configured according to mass spectrometry analysis component parameter sets that include, for example, ionization time parameters and/or waveform parameters. According to exemplary embodiments, instrument 10 can be configured as described in U.S. patent application Ser. No. 10/570,706 entitled Analysis Device Operational Methods and Analysis Device Programming Methods, filed Mar. 3, 2006, the entirety of which is incorporated by reference herein. Instrument 10 may also be configured as described in U.S. patent application Ser. No. 10/570,707 entitled Mass Spectrometry Methods and Devices, filed Mar. 3, 2006, the entirety of which is incorporated by reference herein. The configuration of analysis component 13 according to analysis parameter sets for the analysis of sample 18 can affect what is acquired in the form of data set 20. For example, in the case of mass spectrometry components, the longer the ionization time, the higher the likelihood data set 20 acquired will be indicative of undesirable effects, such as space charge effects (described below).

Processing and control component 12 can be used to configure analysis component 13 according to analysis parameter sets as well as acquire and/or process data set 20. Data set 20 can include data parameters. For example data parameters of data set 20 acquired using an analysis component configured as a high performance liquid chromatograph coupled to a diode-array detector can include total absorbance, total absorbance at a selected wavelength, and/or absorbance during a selected time or time range. As another example, data parameters of data set 20 acquired using an analysis component configured as mass spectrometer can include total analyte ion abundance and/or total abundance at a specified m/z ratio.

Processing and control component 12 can be a computer and/or mini-computer that is capable of controlling the various parameters of instrument 10. Processing and control component 12 can include processing circuitry 22 and storage device 24. Processing circuitry 22 is configured to acquire analytical component parameters from storage device 24 as well as acquire process data set 20 received from detection component 16, for example. Circuitry 22 is also configured to process data set 20 received from detection component 16 and dynamically modify parameters of analysis component 13. The dynamic modification of the parameters of analysis component 13 can take place while instrument 10 is analyzing sample 18 and/or in between analyses of sample 18 utilizing instrument 10, for example.

Processing circuitry 22 may be implemented as a processor or other structure configured to execute executable instructions including, for example, software and/or firmware instructions. Processing circuitry 22 may additionally include hardware logic, PGA, FPGA, ASIC, and/or other structures. In exemplary embodiments, data set 20 may be output from instrument 10 via FPGA processing circuitry 22. In another embodiment, data set 20 may be directly output from a bus of processing circuitry 22 where an appropriate bus feed is provided. Processing circuitry 22 may include an analog to digital converter (ADC) to retrieve, record, and/or convert data set 20 during analog processing utilizing processing circuitry 22. Processing circuitry 22 may also amplify analog signals received from detection component 16 before processing data set 20.

Storage device 24 is coupled to processing circuitry 22 and is configured to store electronic data, programming, such as executable instructions (e.g., software and/or firmware), data, or other digital information that may include processor usable media. Processor usable media includes any article of manufacture which can contain, store, or maintain programming data or digital information for use by, or in connection with, an instruction execution system including processing circuitry in the exemplary embodiment.

Exemplary processor usable media may include any one of physical media such as electronic, magnetic, optical, electromagnetic, infrared or semiconductor media. Some more specific examples of processor usable media include, but are not limited to, a portable magnetic computer diskette, such as a floppy diskette, zip disk, hard drive, random access memory, read only memory, flash memory, cache memory, and/or other configurations capable of storing programming, data, or other digital information.

Processing and control component 12, including processing circuitry 22 in combination with storage device 24, may be utilized to dynamically modify parameters of analysis component 13 by processing data set 20 in the context of the analysis component parameters used to generate data set 20. For example, data set 20 can include parameters of the data set, such as total analyte ion abundance in the case of a mass spectrometry instrument data set. The total abundance can be processed in the context of the analysis component parameters used to generate the data set parameter, such as ionization time parameter of an ion source component. Upon processing data set 20 in the context of the analysis component parameters used to generate data set 20, the component parameters may be modified, analysis component 13 can be reconfigured with the modified parameters, and a subsequent analysis of sample 18 performed using instrument 10 as reconfigured. This dynamic analysis may be utilized continuously or intermittently as the user of instrument 10 desires.

Acquisition and generation of data according to the present invention can be facilitated with processing and control component 12. Processing and control component 12 can be a computer or mini-computer that is capable of controlling the various elements of instrument 10. This control includes the specific application of RF and DC voltages as described herein and may further include determining, storing and ultimately displaying mass spectra. Processing and control component 12 can contain data acquisition and searching software. In one aspect such data acquisition and searching software can be configured to perform data acquisition and searching that includes the programmed acquisition of the total analyte count described above. In another aspect, data acquisition and searching parameters can include methods for correlating the amount of analytes generated to predetermined programs for acquiring data.

Figure 2:
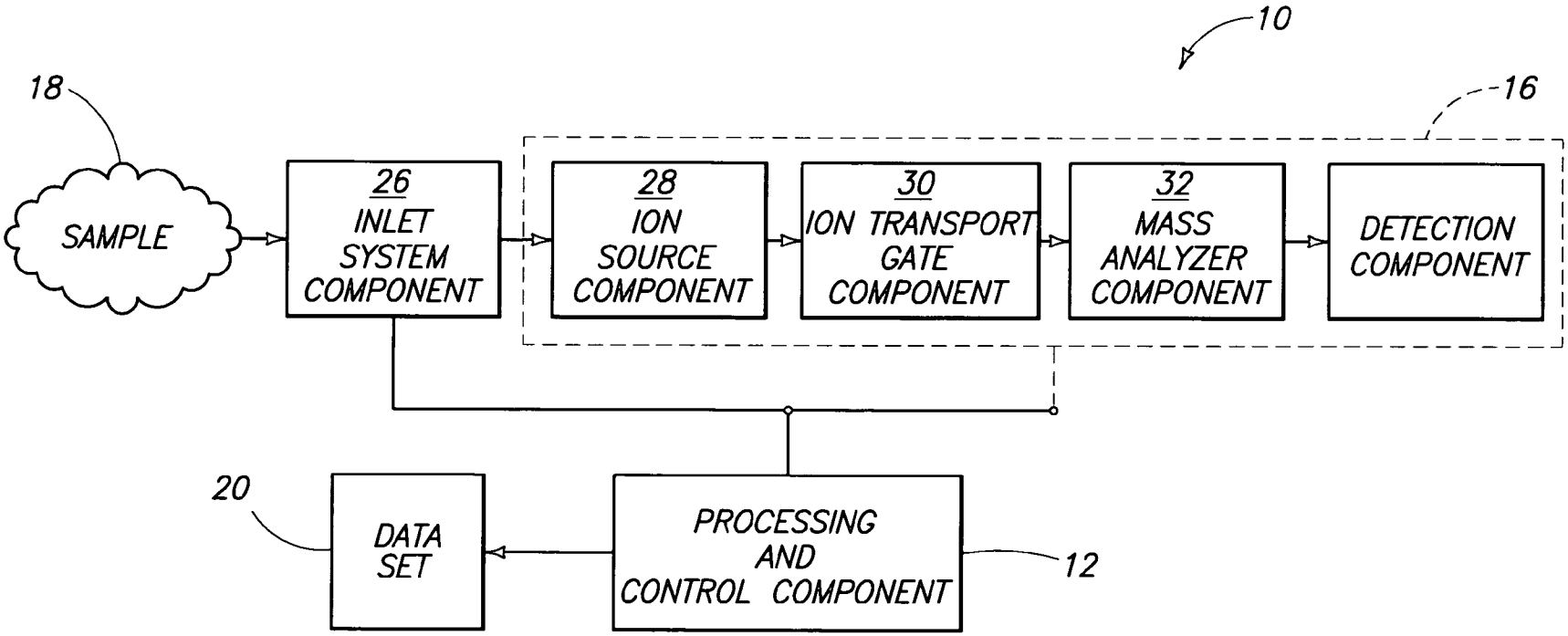
FIG. 2 is one embodiment of a mass spectrometry instrument according to an aspect of the present disclosure.

According to an exemplary embodiment reference is made to FIG. 2, where a block diagram of instrument 10 is shown configured as a mass spectrometry instrument to include an inlet system component 26, an ion source component 28, an ion transport gate component 30, and a mass analyzer component 32, all in connection with a processing and control component 12. As depicted in FIG. 2, a sample 18 can be introduced into inlet system component 26. Analysis of sample 18 will now be described with reference to aspects of the present disclosure in an effort to provide further exemplary embodiments.

Inlet system component 26 can be configured to introduce an amount of sample 18 into instrument 10. Inlet system component 26 may be configured to prepare sample 18 for ionization. Types of inlet system components can include batch inlets, direct probe inlets, chromatographic inlets, and permeable or capillary membrane inlets. Inlet system component 26 may be configured to prepare sample 18 for analysis in the gas, liquid and/or solid phase. In some aspects, inlet system component 26 may be combined with ion source component 28.

Ion source component 28 can be configured to receive sample 18 and convert components of sample 18 into analyte ions. This conversion can include the bombardment of components of sample 18 with electrons, ions, molecules, and/or photons. This conversion can also be performed by thermal or electrical energy. In one aspect, ion source component 28 can provide a predetermined amount of energy to sample 18. Providing this predetermined energy amount to sample 18 provides a sample containing at least one ionized molecule and/or molecules, and can also provide the formation of other molecules and ions, as demonstrated by equation 1 below:

$$M+E \rightarrow M^{+\cdot}+E' \rightarrow M^{+}+F^{+}+N+E'' \quad (1)$$

wherein M represents the neutral analyte molecules, E represents the energy provided to M; $M^{+\cdot}$ represents an internally excited ion; E' represents any E not deposited into $M^{+\cdot}$ as internal or kinetic energy; $M^{+}$, $F^{+}$ and N represent charged analyte ions, charged dissociation products, and neutral dissociation products, respectively; and E" represents any E not remaining in $M^{+}$, $F^{+}$ or N as internal or kinetic energy. A variable energy ion source component 28 may impact the amount of dissociation of sample into these other, molecules ($F^{+}$ and N), for example.

Figure 3:
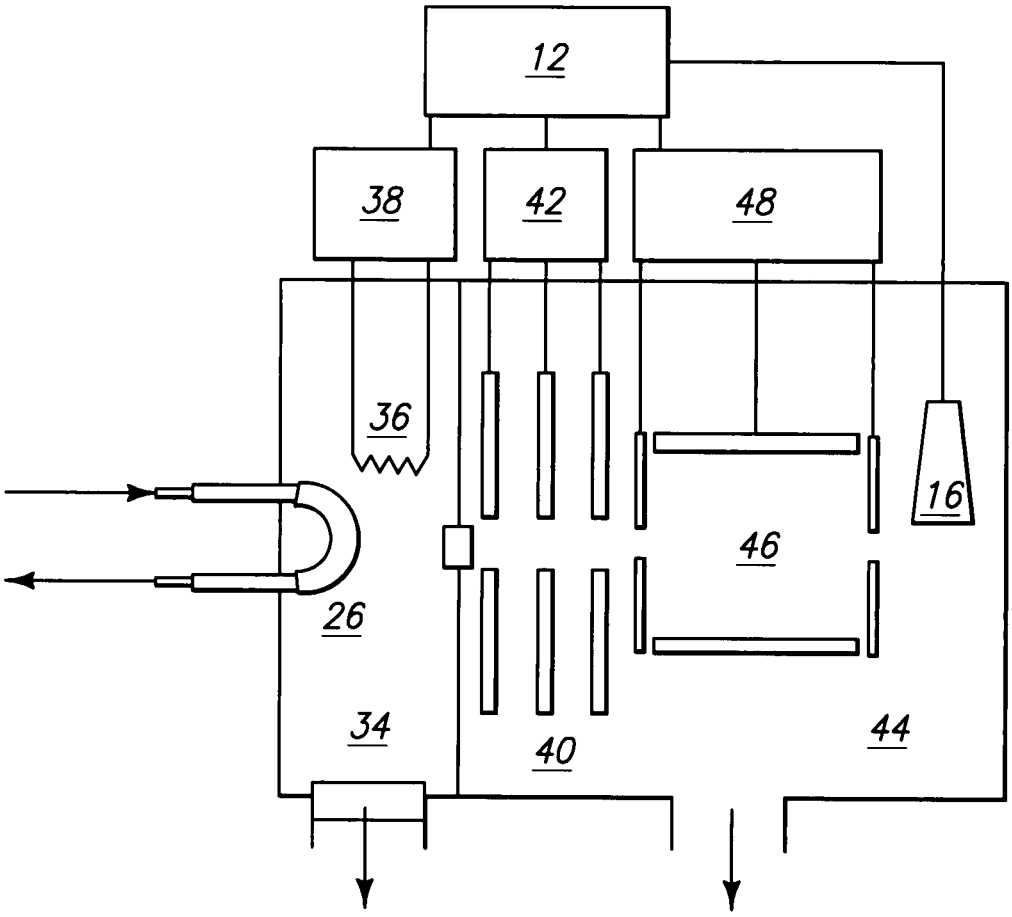
FIG. 3 is one embodiment of a mass spectrometry instrument according to an aspect of the present disclosure.

Ion source 28 may utilize electron ionization (EI, typically suitable for the gas phase ionization), photo ionization (PI), chemical ionization, collisionally activated disassociation and/or electrospray ionization (ESI). For example in PI, the photon energy can be varied to vary the internal energy of the sample. Also, when utilizing ESI, the sample can be energized under atmospheric pressure and potentials applied when transporting ions from atmospheric pressure into the vacuum of the mass spectrometer can be varied to cause varying degrees of dissociation (often referred to as "nozzle/skimmer" or "cone voltage" dissociation). Referring to FIG. 3, an exemplary ion source, which is 28 in FIG. 2, can include a vacuum region 34, EI filament 36 and an EI filament power supply 38.

Referring again to FIG. 2, according to an aspect of the disclosure, analyte ions can proceed to ion transport gate component 30. Ion transport gate component 30 can be configured to gate the analyte beam generated by ion source component 28. Referring again to FIG. 3, an exemplary ion transport gate, which is 30 in FIG. 2, can include ion transport lenses 40 and transport lens power supply 42. According to exemplary embodiments of the disclosure, ion transport gate component 30 can be configured to allow the analyte beam generated by ion source component 28 to continue, or ion transport gate component 30 can be configured to deflect the analyte beam. This can be referred to as "gating" the analyte beam. When the "gate" is open, the analyte beam can pass to mass analyzer component 32; when the gate is closed, the beam is deflected.

An exemplary depiction of "gating" is shown in FIG. 4. Referring to FIG. 4*a*, ion source component 28 generates an analyte beam which is passed through to ion transport gate component 30. As instrument 10 is configured in FIG. 4*a*, the beam generated by ion source component 28 is deflected, the gate is closed. Referring to FIG. 4*b*, ion source component 28 generates an analyte beam and the beam continues to mass analyzer component 32. As configured in FIG. 4*b*, the gate is open. An exemplary method for opening and closing ion transport gate 30 includes providing DC voltages to ion transport gate component 30 to close the gate and removing DC voltages to open the gate. Providing the DC voltages to the ion transport gate is an exemplary analysis component parameter that can be used to configure analysis component 13 using processing and control component 12. With an open gate, the analyte beam can be transferred to mass analyzer component 32 and subjected to further manipulations known in the art, for example, mass analysis, and/or tandem mass spectrometry to acquire data set 20 for processing by processing and control component 12.

Mass analyzer component 32 can include magnetic sectors, electrostatic sectors, and/or quadrupole filter sectors. More particularly, mass analyzer component 32 can include one or more of triple quadrupoles, quadrupole ion traps, cylindrical ion traps, linear ion traps, rectilinear ion traps, ion cyclotron resonance and quadrupole ion trap/time-of-flight mass spectrometers. Quadrupole ion traps or "Paul traps" can refer to an ion trap having a toroidal ring electrode and two end caps. The toroidal ring electrode may have a hyperbolic shape in one cross section. The two end caps may also have a hyperbolic shape in one cross section. Cylindrical ion traps (CIT) have been considered a variation on the quadrupole ion trap where the ring electrode and end caps may have flat surfaces in one cross section. Linear ion traps can consist of sets of parallel rods, the rods being either round, hyperbolic, and/or flat in one cross section. Referring to FIG. 3, an exemplary mass analyzer component 32 can include an analyzer vacuum region 44, a cylindrical ion trap 46, and RF/DC voltage supply 48.

Referring next to FIG. 5, two exemplary configurations of instrument 10 are shown. As depicted in FIG. 5*a*, the DC voltages for ion transport gate component 30 are turned on and the RF trapping voltage for mass analyzer component 32 is turned off, and at the same time the DC potentials of mass analyzer component 32 are turned on. This configuration allows the analyte beam generated by ion source component 28 to pass through ion transport gate component 30 and mass analyzer component 32 to detection component 16. The configuration of the RF trapping voltages are another example of analysis component parameters that may be used to configure analysis component 13 by processing and control component 12 to acquire a data set 20. Exemplary detection components can include one or more of electron multipliers, Faraday cup collectors, and photographic detectors. Detection component 16 can yield a signal which is proportional to the total number of analytes being generated by ion source component 28 over time. The total number of analyte ions being generated over time can be referred to as a total analyte ion count and/or total analyte ion abundance. According to the present disclosure, the total analyte count can be used to control the amount of ions entering mass analyzer component 32. As described earlier, the total analyte abundance is exemplary of a parameter of data set 20 that can be acquired by processing and control component 12 from analysis component 13.

As depicted in FIG. 5*b*, a portion of the analyte ions generated by ion source component 28 can be sampled by mass analyzer 32 based on the total analyte abundance. For example, and by way of example only, processing and control component 12 can be configured with a desired amount of analyte ions that are to be analyzed by mass analyzer component 32. Processing and control component 12 can then configure instrument 10 to allow only this amount of analyte ions to enter mass analyzer component 32 by configuring ion transport gate component 30 to open and close at desired intervals. The opening and closing of transport gate component 30 at these intervals are analysis component parameters dictated by processing and control component 12, for example. Instrument 10 can be configured according to exemplary analysis component parameter sets for sampling by opening ion transport gate component 30 and applying RF voltages to mass analyzer component 32 while not applying DC potentials. This configuration may be maintained for a set time based on the total analyte ion abundance determined prior and/or at predefined time(s). It is understood that the total analyte ion abundance can vary depending on the characteristics of sample 18, the configuration of ion source component 28, the configuration of mass analyzer component 32, and the experiment being performed. Processing data set 20 acquired using analysis component 30 configured with analysis parameter sets as described, a mass analyzer component can be filled for a predefined time and manipulations of the mass analyzer known in the art may be performed on the population within the mass analyzer component.

Figure 6:
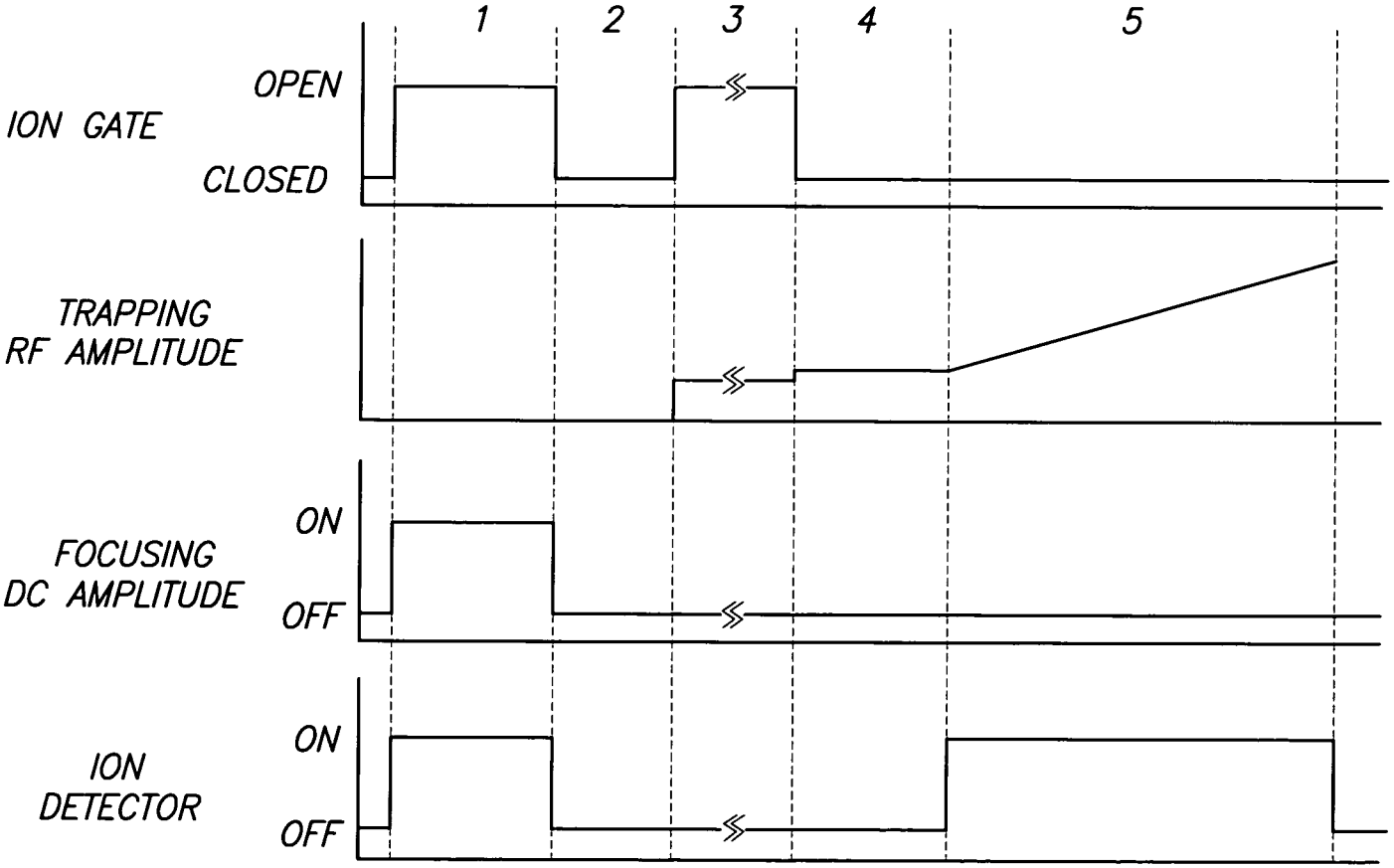
FIG. 6 depicts analysis component parameter set configurations according to the present disclosure.

Referring to FIG. 6, control of components of instrument 10 are shown in graphical form to illustrate exemplary analysis component parameter sets using analysis component 13 configured according to analysis component parameter sets. As shown in analysis component parameter set 1, ion transport gate component 30 is open, the RF trapping amplitude of mass analyzer component 32 is off and the DC voltages of mass analyzer component 32 are on while detection component 16 is on. Configured according to this analysis component parameter set allows an analyte beam to pass from ion source component 28 to detection component 16 and be measured as illustrated in FIG. 5*a*. During analysis component parameter set 2, ion transport gate component 30 is closed, the focusing DC voltages of mass analyzer component 32 are off and detection component 16 is turned off. The total analyte ion abundance can be a parameter of data set 20 determined from the beginning of analysis component parameter set 1 to the beginning of analysis component parameter set 2. This abundance can be used to determine the length of time of the remaining stages. For example, the total ion abundance can be processed by processing and control component 12 to create additional analysis component parameter sets that may then be used to configure analysis component 13 and acquire additional data sets 20.

According to exemplary embodiments, during analysis component parameter set 3, the trapping RF of mass analyzer component 32 is turned on, focusing DC amplitude is turned off, and ion transport gate component 30 is open. Mass analyzer component 32 is filled for a predefined time or a time calculated from the total analyte ion abundance. As depicted in FIG. 6, during analysis component parameter set 4, analysis component 13 can be configured with an optional analyte cooling period. During analysis component parameter set 5 analysis component 13 can be configured to provide a waveform via the application of a trapping RF amplitude ramp with detector 16 turned on. Additional periods between sets 4 and 5 for other ion manipulations known in the art are of course possible, and the mass analysis method used during set 5 can include trapping RF ramp with auxiliary voltages applied or non-destructive detection of ions.

According to exemplary implementations, mass analyzer components 32, such as linear ion traps may have an RF voltage applied to the parallel rod electrodes during the analyses such as those with analysis component 13 configured according to the analysis component parameters of set 1. This can provide focusing of the analyte beam to the detector. This focusing RF may be at a different amplitude and/or frequency than the trapping RF used to store ions for manipulation as described in sets 3-5 in FIG. 6.

Referring to FIG. 7, a mass spectrometry instrument 70 is shown. Instrument 70 can include an ion gate/mass analyzer configuration 72 coupled to ion source component 28, for example. As depicted in FIG. 7, a secondary ion gate component 74 and mass analyzer component 76 can be utilized as described above to singularly determine the total analyte ion abundance generated by ion source component 28. The total analyte count can then be utilized to configure ion gate component 30, mass analyzer component 32 and detection component 16 for sampling as described above.

Figure 8:
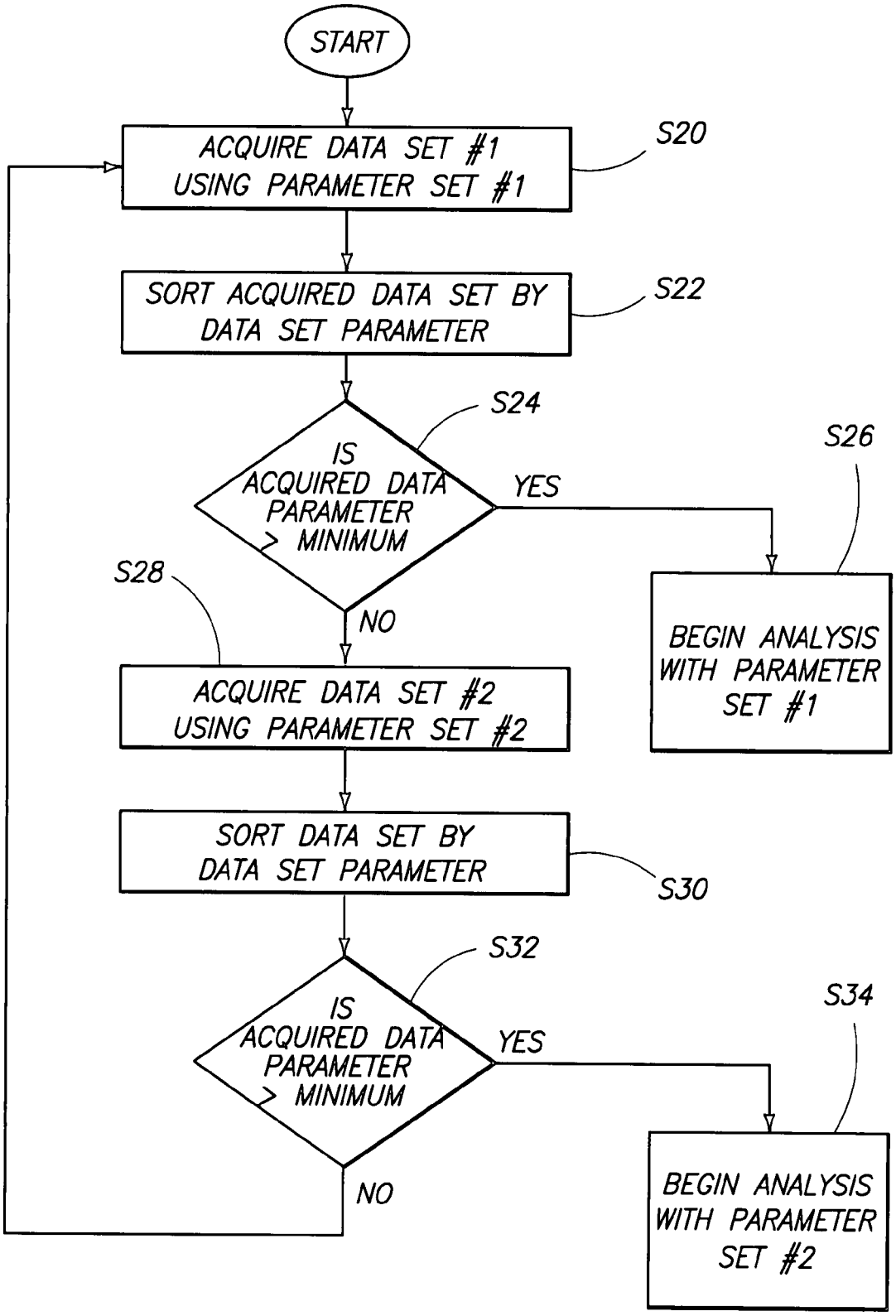
FIG. 8 is a process according to an embodiment.

Referring to FIG. 8, in an exemplary embodiment, analysis component parameter sets may be selectively dictated, for example, through selection of one or more of a plurality of data set parameters and the subsequent processing of the selected data set parameters in the context of the analysis component parameter(s) used to acquire the data set. 32. According to exemplary embodiments the processing and control component 12 can be configured to acquire sample characteristics in the form of data sets 20 using analysis component 13 configured according first and second analysis parameter sets selectively dictated by processing and control component 12. According to exemplary implementations, the first and second analysis sets can be different from one another. FIG. 8 is exemplary of the processing steps utilizing processing circuitry 22 (FIG. 1) to perform this selection. Other methods are possible including more, less or alternative steps.

At S20, data set #1 is acquired using an instrument configured with analysis component parameter(s) set #1. According to exemplary embodiments, analysis component 13 can be configured according to a first analysis component parameter set as dictated by processing and control component 12. Analysis component parameter set #1 can be used to configure analysis component 13 (FIG. 1) and acquire data set 20 (FIG. 1), for example. In keeping with the theme of mass spectrometry but not limited thereby, analysis component parameter set #1 can be the parameter set of mass spectrometry analysis components. For example and by way of example only, analysis component parameter set #1 can define a predefined mass range for mass spectrometry analysis, and/or gating configuration as described above.

Data set #1 can include the data acquired utilizing an instrument configured with analysis component parameter set #1. In keeping with the theme of mass spectrometry as above, data set #1 can be the data set acquired using a mass spectrometry instrument. For example, and by way of example only, the data set can include data set parameters such as total ion current, selective ions detected, selected mass range detected, and/or mass spectra detected.

Hereafter the process proceeds to S22 where the data set acquired in S20 is sorted by a predefined data set parameter and/or parameters to isolate predefined data parameter(s), such as total analyte ion abundance.

The process then can proceed to S24 where a determination is made as to whether or not the acquired data parameter sorted in S22 is greater than a predefined minimum. According to exemplary embodiments, the predefined minimum may be associated with the first analysis component parameter set within storage device 24, for example. The acquired data parameter of the first data set can be compared with the defined threshold amount to selectively dictate the first or second analysis parameter set to the analysis component. For example, if a total amount of a certain ion is the acquired data parameter, then a determination would be made if that amount of ion is greater than the predefined minimum ion amount. Where the acquired data parameter is greater than the predefined minimum, the process proceeds to S26 and analysis begins with instrument 10 (FIG. 1) configured with analysis component parameter set #1.

In the case the acquired data parameter is less than the minimum, the process proceeds to S28 where data set #2 is acquired using analysis component parameter set #2, the second analysis component parameter set. In an exemplary embodiment, and in keeping with the theme of mass spectrometry, analysis component parameter set #2 can include a mass spectrometry range other than the mass spectrometry range defined using analysis component parameter set #1 above, or parameter set #2 can include a longer open gate time to facilitate the acquisition of more analyte ions by mass analyzer 32 (FIG. 2), for example.

The process proceeds to S30 where the acquired data set #2 is sorted by one or more predefined data set parameters that may be equivalent to the predefined data set parameters used to sort data set #1 above. For example, the data set can be sorted by data set parameters such as abundance of an ion and/or TIC.

Proceeding to S32, a determination is made as to whether or not the acquired data parameter sorted in S30 is greater than a predefined minimum. This predefined minimum may be associated with the second analysis component parameter set in storage device 24, for example. For example, as described above, whether or not the ion abundance and/or TIC acquired using the instrument configured with analysis component parameter set #2 is greater than a predefined ion abundance or TIC minimum. In the case the acquired data parameter is greater than the minimum, the process proceeds to S34 which dictates that analysis should begin starting with analysis component parameter set #2. Where it is the case that the predefined data parameter is less than the minimum the process can return to S20.

As but one example utilizing the process described in FIG. 8, instruments, such as instrument 10 (FIG. 1) may be configured with a plurality of analysis component parameter sets and the instrument may be able to cycle through at least two of these analysis component parameter sets while acquiring data. In exemplary embodiments this process can be utilized for continuous monitoring. As such, an acquired data parameter may be indicative of a sample 18 (FIG. 1) having a characteristic that is best analyzed utilizing the instrument configured with the analysis component parameter set that was used to first detect the characteristic.

Utilizing this process, for example, and in keeping with the mass spectrometry theme but not limited thereby, instrument 10 (FIG. 1) may be configured for environmental monitoring. In this configuration, instrument 10 (FIG. 1) may be configured for continuous air sampling at a predefined site. For example, the site may contain known compounds such as ethanol and/or BTEX (benzene, toluene, ethylbenzene, xylenes) but it is unknown whether the compounds are present at the same location or at different locations within the site. The instrument can be configured with an ethanol analysis component parameter set designed to acquire a data parameter set that can include the characteristic data set parameter of ethanol (e.g., m/z 31, m/z 45, and m/z 46). With reference to S22 of the process of FIG. 8, for example, where it is the case that a data set parameter characteristic of ethanol is greater than the predefined minimum, at S26 analysis begins with the ethanol analysis component parameter set.

With reference to S28 of FIG. 8, for example, the instrument may be configured with a BTEX analysis component parameter set that can be designed to acquire a data set than can include the characteristic data set parameter of BTEX (e.g. m/z 78, m/z 91, and/or m/z 105). Where these data set parameters are greater than predefined minimum, at S28 analysis can start with the BTEX analysis component parameter set. In so doing, instrument 10 (FIG. 1) can perform an exemplary dynamic analysis by dynamically modifying the parameters of its analysis components.

Figure 9:
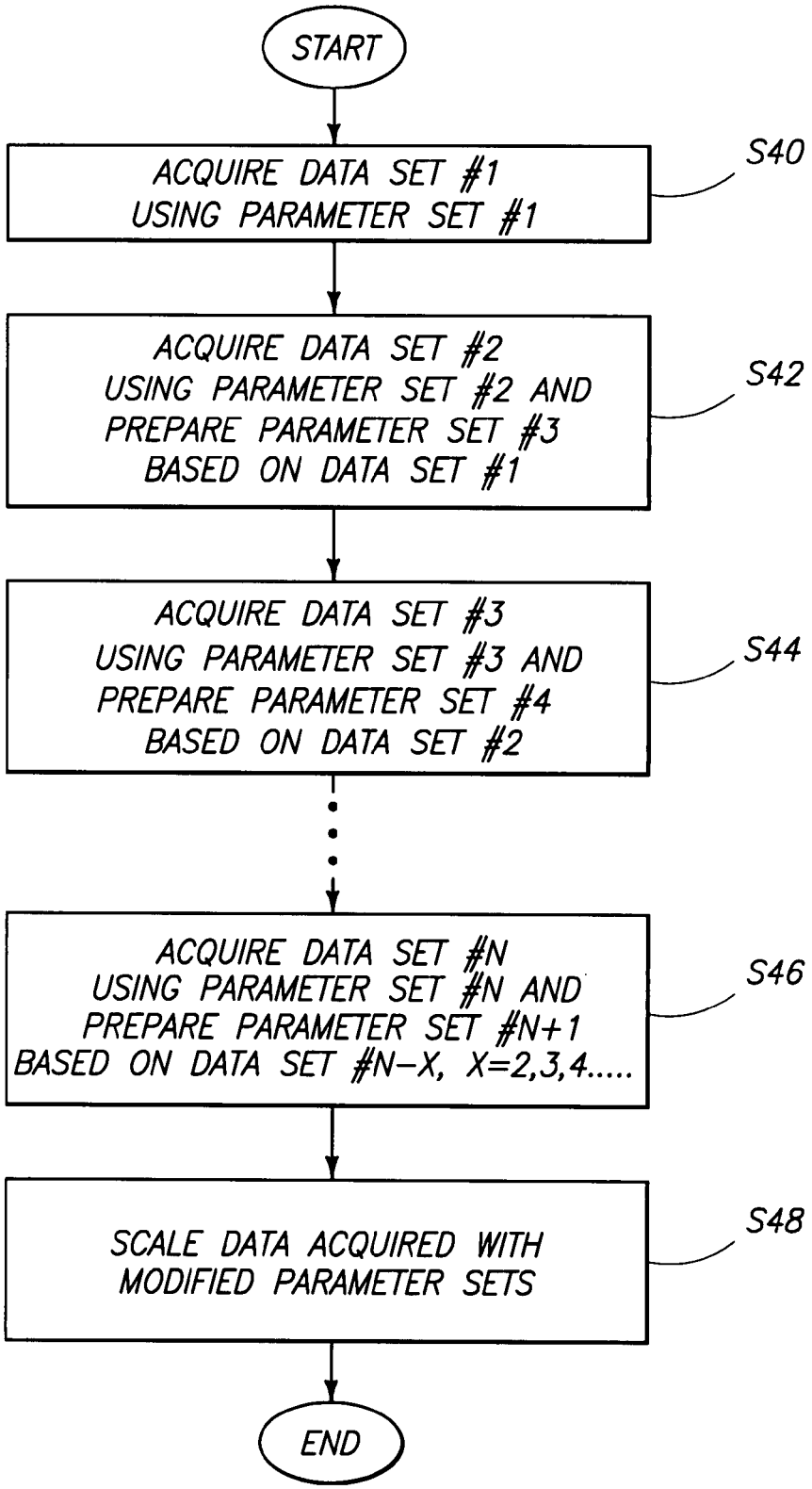
FIG. 9 is a process according to an embodiment.

In accordance with an exemplary embodiment and referring to FIG. 9, a process for dynamically modifying instrument analysis component parameters is described. This process can be performed in parallel, sequentially, and/or intermittently during acquisition of data sets using an analysis instrument such as that described with reference to FIG. 1, for example. In exemplary embodiments, modified instrument parameters may be prepared by processing and control component 12 during data acquisition and/or upon completion of data acquisition as the instrument operator dictates. For example, sample analysis apparatuses can include processing circuitry configured to acquire one data set from an analysis component configured according to at least one analysis parameter set, and prepare another analysis parameter set using another previously acquired data set. According to other exemplary embodiments, the processing circuitry can be configured to simultaneously acquire the one data set and prepare the other analysis parameter set.

Analytical methods can include acquiring first and second data sets from an analysis component configured according to a first analysis component parameter set provided to the analysis component from a process and control component coupled to the analysis component. The methods can also include processing the first data set to prepare a second analysis component parameter set using the process and control component.

According to exemplary embodiments, the processing of the first data set can be performed during the acquiring of the second data set. The analysis component can also be configured according to the second analysis component set. Methods can also include acquiring a third data set from the analysis component configured according to the second analysis component set, and processing the second data set to prepare a third analysis component parameter set using the process and control component. The processing of the second data set can be performed during the acquiring of the third data set, for example.

For example and referring first to S40, a data set #1 can be acquired using an analysis instrument configured with analysis component parameter set #1. According to exemplary embodiments, analysis component 13 can be configured to include the ion source component, the transport gate component and the mass analyzer component. These components can be configured to provide analyte ions to the detection component according to one analysis component parameter set and reconfigured according to another analysis component parameter set, for example. The analysis component parameter sets can include one or more of ion gate position parameters, trapping RF amplitude parameters, focusing DC amplitude parameters, and detector power parameters described in detail previously. Parameter set #1 can be predefined and/or can be dictated using the process described above in FIG. 8.

The process proceeds to S42 where data set #2 is acquired using analysis component parameter set #2 and simultaneously, for example, analysis component parameter set #3 is prepared by processing data set #1 using processing and control component 12. The process proceeds to S44 where data set #3 is acquired using analysis component parameter set #3 prepared in S42 and analysis component parameter set #4 is prepared based on data set #2 acquired in S42. The process can continue in this acquisition and parameter preparation mode as continued in S46 where data set N is acquired using analysis component parameter set N, and analysis component parameter set N+1 is prepared from data set N−X, with X being 2, 3, 4, etc.

The process can then proceed to S48 where, in an exemplary embodiment, but not necessarily, the data sets and/or individual data set parameters acquired during the process can be scaled consistent with the prepared analysis component parameter sets. According to exemplary embodiments, processing circuitry 22 of processing and control component 12 can be further configured to scale the data sets using the analysis parameter sets used to acquire the data sets. For example, the analysis parameter sets can include a gating parameter and the data sets are scaled using the gating parameter, such as the length of time the gate is open.

Figure 10:
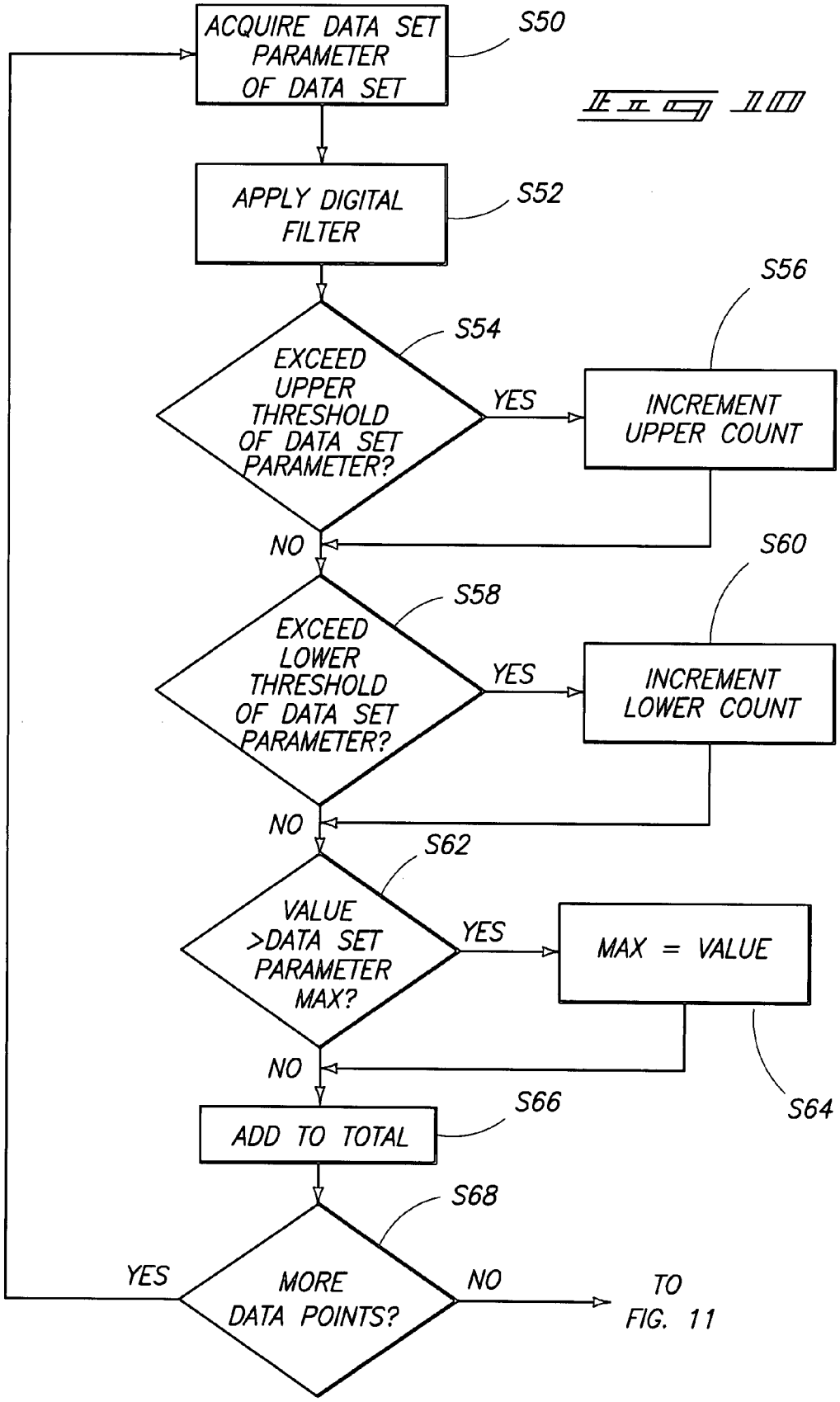
FIG. 10 is a portion of a process according to an embodiment.

Referring to S42, S44, and S46 of FIG. 9, analysis component parameter sets can be prepared based on previously acquired data sets. Referring to FIG. 10, an exemplary process for preparing analysis component parameter sets based on data sets is depicted. The process can begin with S50 where a data set parameter of the data set can be acquired. The process can, but does not necessarily need to, include S52 which provides the application of a digital filter to the data set parameter acquired in S50.

The process then continues to S54 where a determination is made as to whether or not the data set parameter exceeds a predefined upper threshold. For example, another analysis parameter set is prepared by acquiring a data set parameter of another data set and comparing the other data set parameter to a threshold amount. According to exemplary embodiments, the data set parameter is the total analyte ion abundance of the data set. The threshold amount can be an upper limit amount of the abundance, for example. The comparing can include determining an excess of the upper limit amount and storing the excess.

The apparatus can be configured with the threshold amount being a lower limit amount and the comparing can include determining a deficiency of the lower limit amount and storing the deficiency. For example, if the data set parameter does exceed the upper threshold then an incremental count of the exceeding amount is made at S56 and then the process continues to S58 where a determination is made as to whether or not the data set parameter exceeds a predefined lower threshold. Where the lower threshold is exceeded an incremental count of the exceeding data set parameters of that lower threshold is made and then the process continues on to S62 where a determination is made to whether the data set parameter has exceeded a predefined maximum value. According to exemplary implementations, the other analysis parameter set is further prepared by comparing the stored excess to this excess maximum. Where the predefined maximum value has been exceeded, that value is noted in S64, the process continues to S66, and a summation of the upper counts, lower counts, and the determination of the number of times the maximum value has been exceed is recorded.

Upon summation, the process can continue to S68 where a determination is made as to whether or not more data is required. If more data is required, the process returns to S50; if not, the process can continue onto the process outlined in FIG. 11, beginning with S70.

According to exemplary embodiments the apparatus can be configured to compare the excess count of the data parameter with data set parameter limit associated with the analysis component parameters used to acquire the data set. For example, referring to FIG. 11 and S70, a determination of whether or not the incremental upper count has exceeded the data set parameter limit is made. If the upper count has been exceeded, the process can continue onto S72 where the analysis component parameter set used to acquire the data set can be modified.

When the upper count has not exceeded the upper count limit, the process can continue to S74 where a determination is made as to whether the recorded maximum value(s) have exceeded the maximum value limit. If the limit has been exceeded, the process can continue onto S72 as described above. If not, the process can continue onto S76 and a determination is made as to whether the total of the maximum value exceeding times and the upper count limit exceeds a predefined data set parameter limit and if so, the process proceeds onto S72 as described above.

From S72, after modification of the analysis component parameter set, a determination is made as to whether the modified analysis component parameter set includes a predefined analysis component parameter that is greater than a predefined minimum in S78. Where the modified parameter is greater than the predefined minimum, the process proceeds to S82 where the modified analysis component parameter set is stored. For example, where the data set parameter is the total analyte ion abundance of the data set and it is determined that the excess is greater than the upper limit, the analysis component parameter set used to acquire the data set can be modified to include a decreased ionization time parameter. This modified analysis component parameter set may then be used to reconfigure analysis component 13 as described.

Where the modified parameter is less than the predefined minimum, the modified parameter is set at a predefined minimum and the modified parameter set is stored in device 24 (FIG. 1), for example. In exemplary embodiments, the modified analysis component parameter set can be stored for use in analysis of a sample and preparation of a data set. For example, referring to FIG. 9 and S42, this modified analysis component parameter set can include parameter set #3 based on data set #1.

According to exemplary embodiments, the modified analysis parameter set can be prepared by comparing the stored deficiency to a deficiency maximum. For example, referring to S76 of FIG. 11, where the upper count limit is less than the total limit in S70, the maximum is less than the limit in S74, and the total is less than the limit in S76, the process proceeds to S84 where a determination is made as to whether the lower count of the data parameter is less than a predefined data parameter limit. Where it is the case that the lower count is less than the limit, the process proceeds to S86 where the analysis component parameter set used to acquire the data parameter is modified. From S86 the process proceeds to S88 where a determination is made as to whether the modified analysis component parameter is greater than the predefined parameter maximum. Where it is the case that the modified analysis component parameter is greater than the predefined parameter maximum, the process proceeds to S90 where a predefined maximum parameter is used in the modified parameter set and the modified parameter set is stored. Where it is the case that the modified parameter is less than the maximum in S88, the process proceeds to S92 where the modified parameter set is stored. For example, where the data set parameter is the total analyte ion abundance of the data set, increasing the ionization time parameter of the analysis parameter set used to acquire the data set can be used to form another analysis parameter set and this other analysis parameter set can be used to configure analysis component 13.

Figure 11:
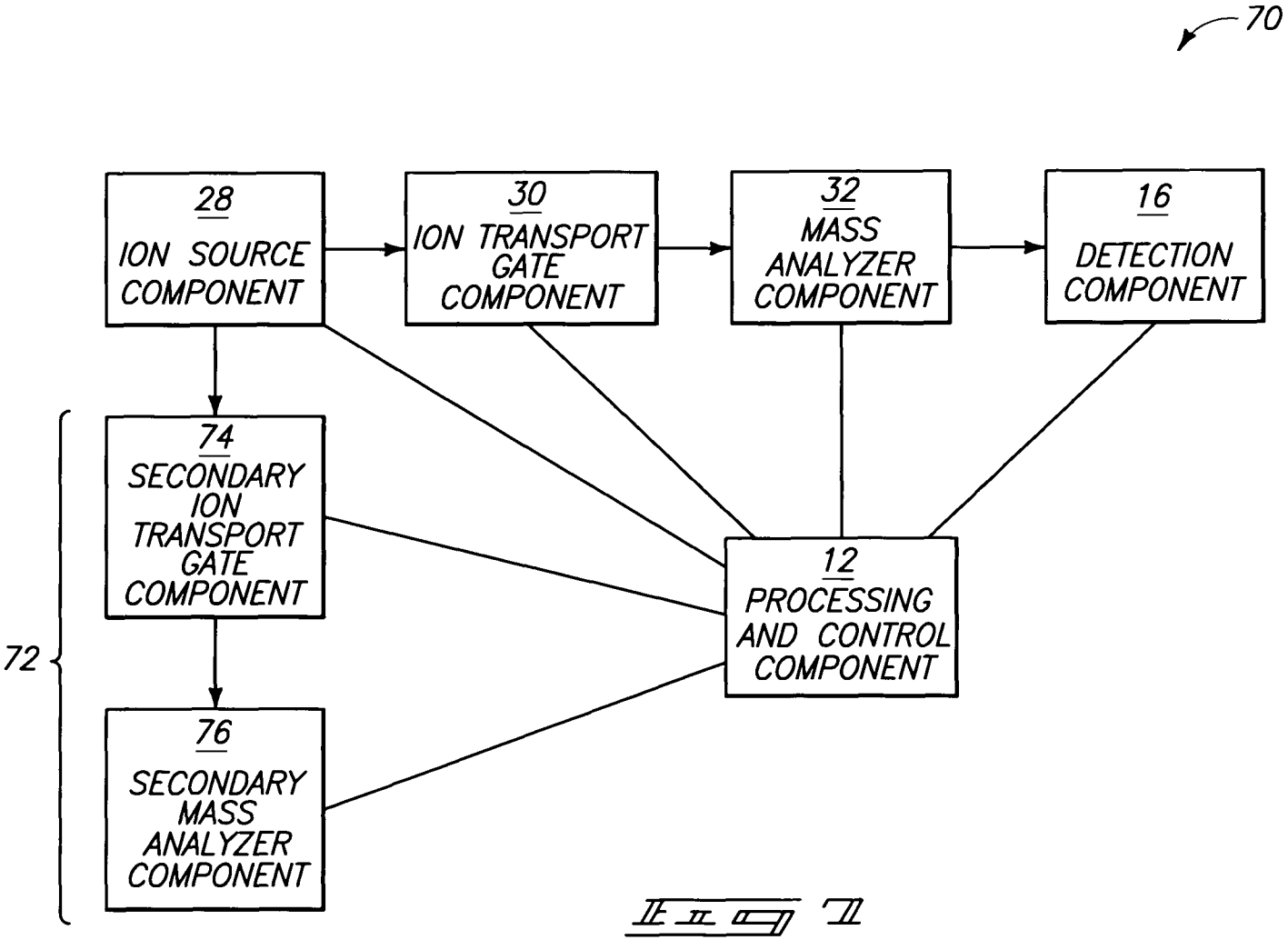
FIG. 11 is another portion of the process of FIG. 10 according to an embodiment.

Referring to S84 of the process shown in FIG. 11, where it is the case that the lower count limit is less than the predefined limit, the same analysis component parameter set as that used to acquire the data set is stored. The stored modified analysis component parameter sets or unmodified analysis component parameter sets, when referring to S94, for example, may be used in conjunction with the process outlined in FIGS. 8, 9, and/or 12 (discussed next), for example, to dynamically modify the analysis component parameter sets of an analytical instrument such as analytical instrument 10 (FIG. 1) while at the same time acquiring data, or "on the fly".

Figure 12:
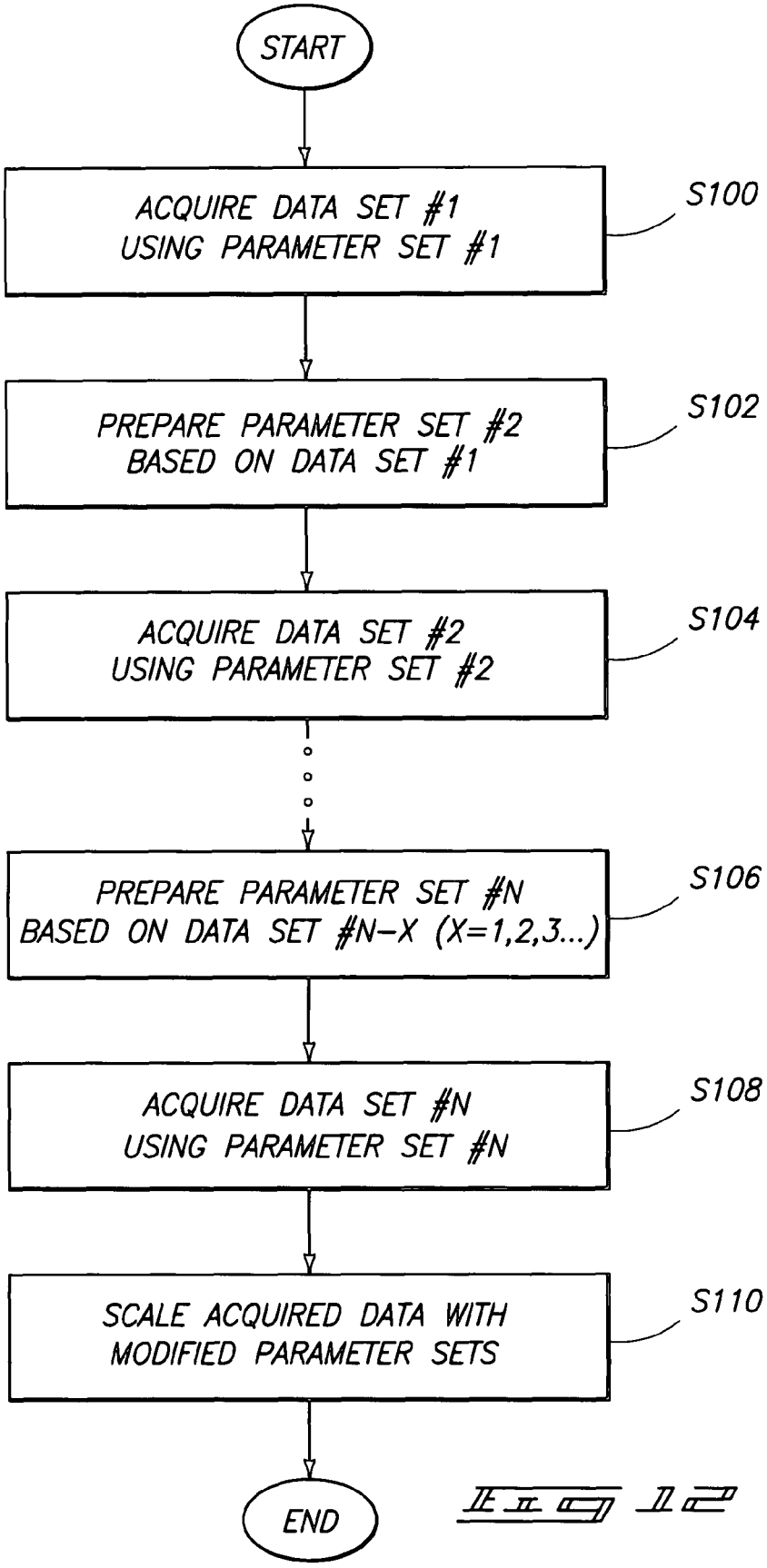
FIG. 12 is a process according to an embodiment.

Referring to FIG. 12, an embodiment also provides a dynamic analysis process for acquiring data sets and modifying analysis component parameter sets before acquiring subsequent data. The process of FIG. 12 can begin with S100 which dictates acquiring data set #1 using an instrument configured with analysis component parameter set #1. The process continues onto S102 which provides for preparing analysis component parameter set #2 based on data parameter set #1. This preparation of analysis component parameter set #2 based on data parameter set #1 can be performed as described above with reference to FIGS. 10 and 11. The process can continue onto S104 and data set #2 can be acquired using analysis component parameter set #2 prepared in S102. The process can then proceed to S106 which provides for preparing analysis component parameter set #N based on data #N-X, where X is equal to 1, 2, 3 . . . etc. As is shown, when referring to S108, data set #N can be acquired using analysis component parameter set #N prepared in S106. The process can continue to S110 where the acquired data set can be scaled with modified analysis component parameter sets.

As is indicated using the variable N in FIGS. 9 and 12, the processes do not require a predefined sequence of analysis component parameter set preparation based on data sets. Processes can provide for the preparation of analysis component parameter sets at any point in the process of acquiring data sets. The disclosure contemplates an algorithm that predefines the preparation of analysis component parameter sets based on data sets at points in the process defined by the algorithm.

Referring to FIGS. 9 and 12 consecutively and respectively S48 and S110, data sets acquired with modified analysis component parameter sets can be scaled. In an exemplary embodiment, this scaling can include a proportional multiplication or reduction of data parameters acquired in context of the extent of the modification made to the analysis component parameters. For example, and by way of example only, and in keeping with the theme of mass spectrometry but not limited thereby, ionization time may be just one of many analysis component parameters modified in an analysis component parameter set. The modified analysis component parameter set can give rise to a data set that includes an ion abundance data parameter, for example. The ion abundance may be scaled according to the modification of the ionization time parameter. The scaling may be proportional or scaled using a predefined equation but regardless the data parameter can be scaled in the context of the modified parameter set.

In keeping with the theme of mass spectrometry but not limited thereby, recall the gating described above with reference to instrument 10 and FIGS. 1-6, for example. In an exemplary embodiment, initial parameters can be dynamically modified to allow for a similar number of analyte ions being provided to the mass analyzer component, for example, by altering an ion transport gate parameter such as ionization time as sample concentration changes.

In an exemplary embodiment, the ionization time parameter for a given parameter set can be varied, for example, by modifying an ionization parameter based on previously acquired data and providing these modified parameters to the components of the instrument during subsequent analyses. As described above, mass analyzer components can have parameters provided to them that include such parameter(s) as voltage waveforms that manipulate the analyte ions in the mass analyzer component such as an ion trap. These voltage waveform parameters in combination with other analytical parameters such as ionization time parameters can be dynamically modified and dictated to the analysis components with the processing and control components via relays that control the timing of various events during analysis in accordance with the processes described herein.

For example, an instrument can produce an RF waveform parameter and apply that parameter to a mass analyzer component. In so doing, the mass analyzer component can be configured to store analyte ions of a predetermined mass to charge ratio and analyze analyte ions by providing specific analyte ions to detection components at predetermined frequencies by executing the digitized waveform information at a fixed rate. The rate can include rates such as 20 million samples per second (MSamples/sec). In an exemplary embodiment, analytical parameters can be provided to an instrument with the analytical parameters including an ionization time parameter having a fixed period of ionization as the first event of the mass analysis parameter. The ionization time parameter can be set to any value from zero to the full period specified in the mass analysis parameter, for example, by specifying the start offset of the mass analysis scan parameter to something other than the first data point of the scan.

For example, if a scan parameter is downloaded to the mass analysis component, such as an ionization parameter of 10 milliseconds, this can represent 200,000 data points stored in memory to represent the RF waveform of the mass analysis component during that 10 millisecond period. Where an ionization time of 5 milliseconds is provided to the instrument, the instrument can begin clocking out the data set acquired from the instrument not with the first point of the ionization time, but rather at data point number about 100,000 later in the mass analysis scan parameter. In exemplary embodiments, the relay that allows for providing the ionization time can be turned on during this 5 millisecond time period resulting in a 5 millisecond ionization time. By specifying where to begin clocking out the data, the ionization time can be set to any value required without the need to recalculate the waveform parameter downloaded to the mass analyzer component.

In particular embodiments, and with reference to FIGS. 8, 9, and 12 above, data sets acquired utilizing previous analytical parameters can be used to determine the amount of analyte entering the mass analyzer component and to calculate a new parameter such as the ionization time for use to prepare a modified parameter set. Data set parameters that can be used to determine the amount of analyte present in the mass analyzer and hence the ionization time to use for subsequent analyses can include the heights of the mass spectral peaks, the widths of the mass spectral peaks and/or the summed abundance of the mass spectral peaks (i.e., the total ion current (TIC)), or any combination of these or other factors. In exemplary embodiments, the processes described in FIGS. 8, 9, and 12 do not utilize a pre-scan which can introduce a one scan lag between the modification of the analytical parameters and the modified parameters utilized in the subsequent analysis.

In exemplary embodiments and as described above with reference to FIG. 8, the process can utilize alternating parameter sets having two separate ionization time parameters, for example. In exemplary embodiments, as described above, this can be used for setting two range parameters for the mass analyzer component across the full ionization time parameter capability of the instrument, in order to more rapidly respond to a broader range of ion output changes in the mass analyzer component. In exemplary embodiments, to achieve high sensitivity for low concentration samples, the first parameter set can include a first ionization parameter having a long ionization time that can be nearer the maximum ionization time allowed for the analysis. To minimize the space charge for high ion concentration samples, the second parameter set can be configured to use a much shorter ionization time. When no sample is being introduced from the sample inlet component, the instrument can alternate between the two scans. When a sample is introduced and data set parameter such as specific ions and/or a TIC are detected, a process can be applied to determine whether subsequent processes should begin modifying parameter sets such as optimizing an ionization time parameter at longer or shorter values. This can allow for more rapid optimization of the ionization time for the particular sample concentration being presented to the instrument, for example. The data sets acquired with a parameter set can be analyzed to determine whether or not the parameter set should be modified and provide a modified parameter set if necessary.

Figure 13:
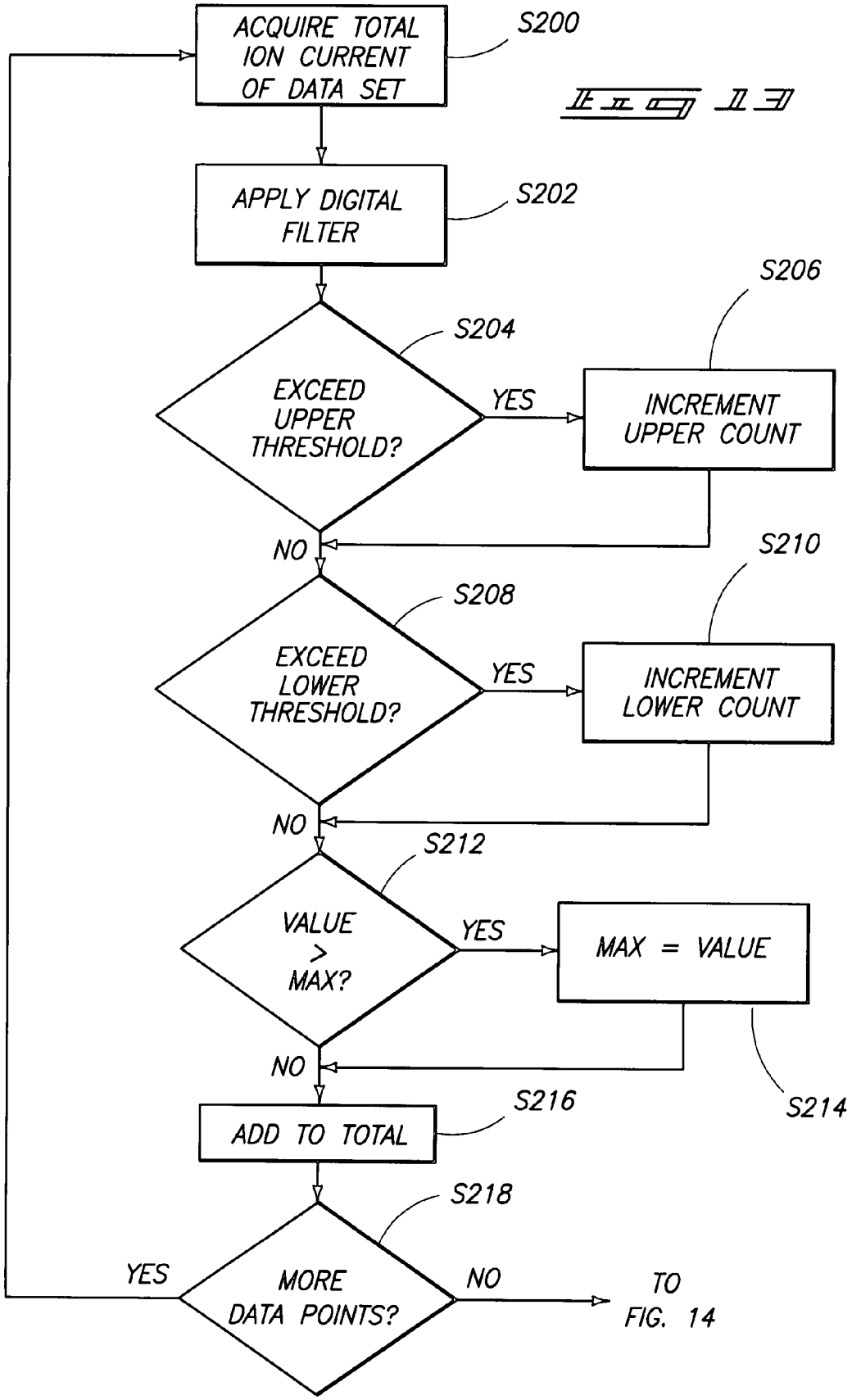
FIG. 13 is a portion of a process according to an embodiment.
Figure 14:
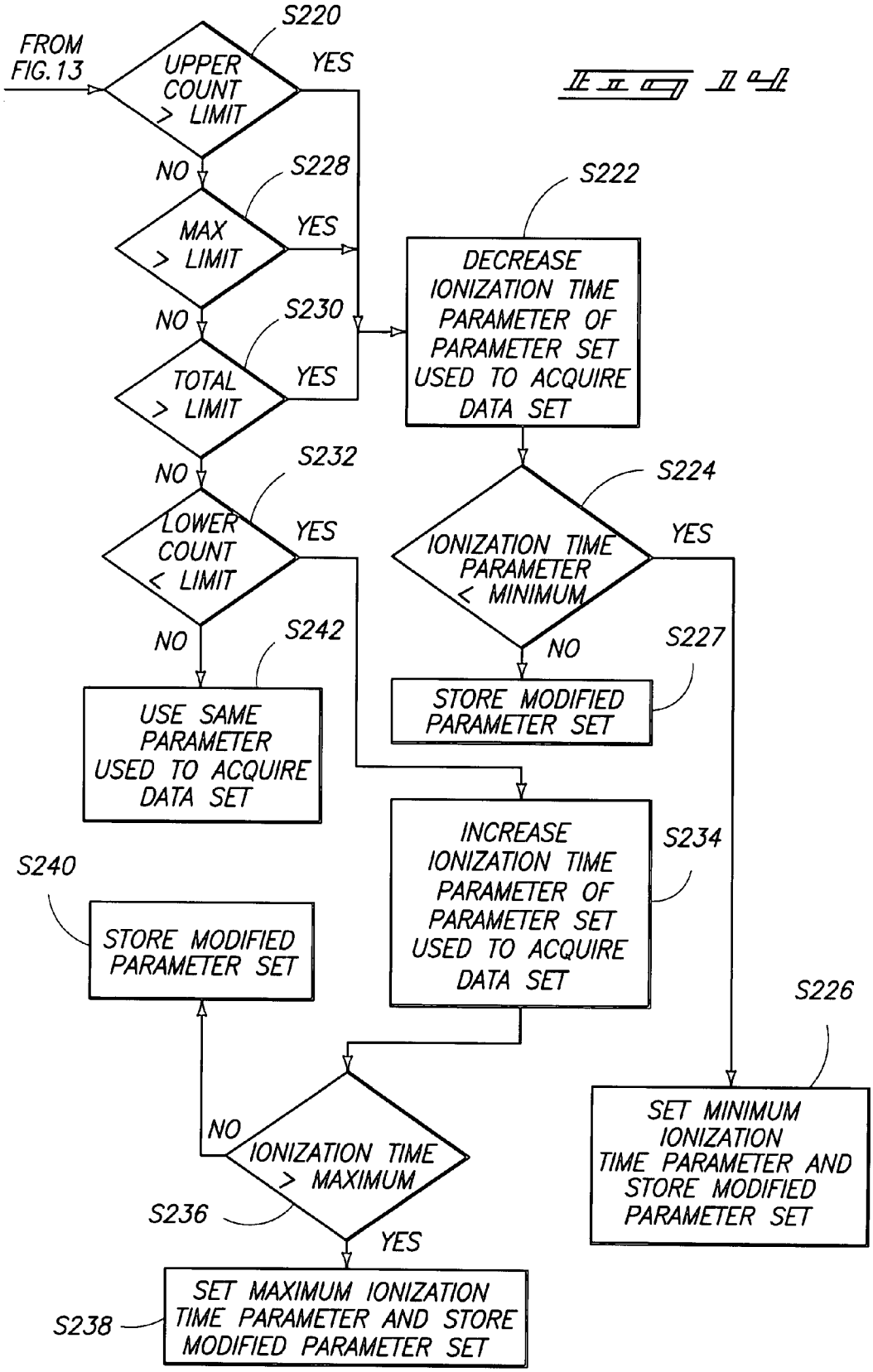
FIG. 14 is another portion of the process of FIG. 13 according to an embodiment.
Figure 11:
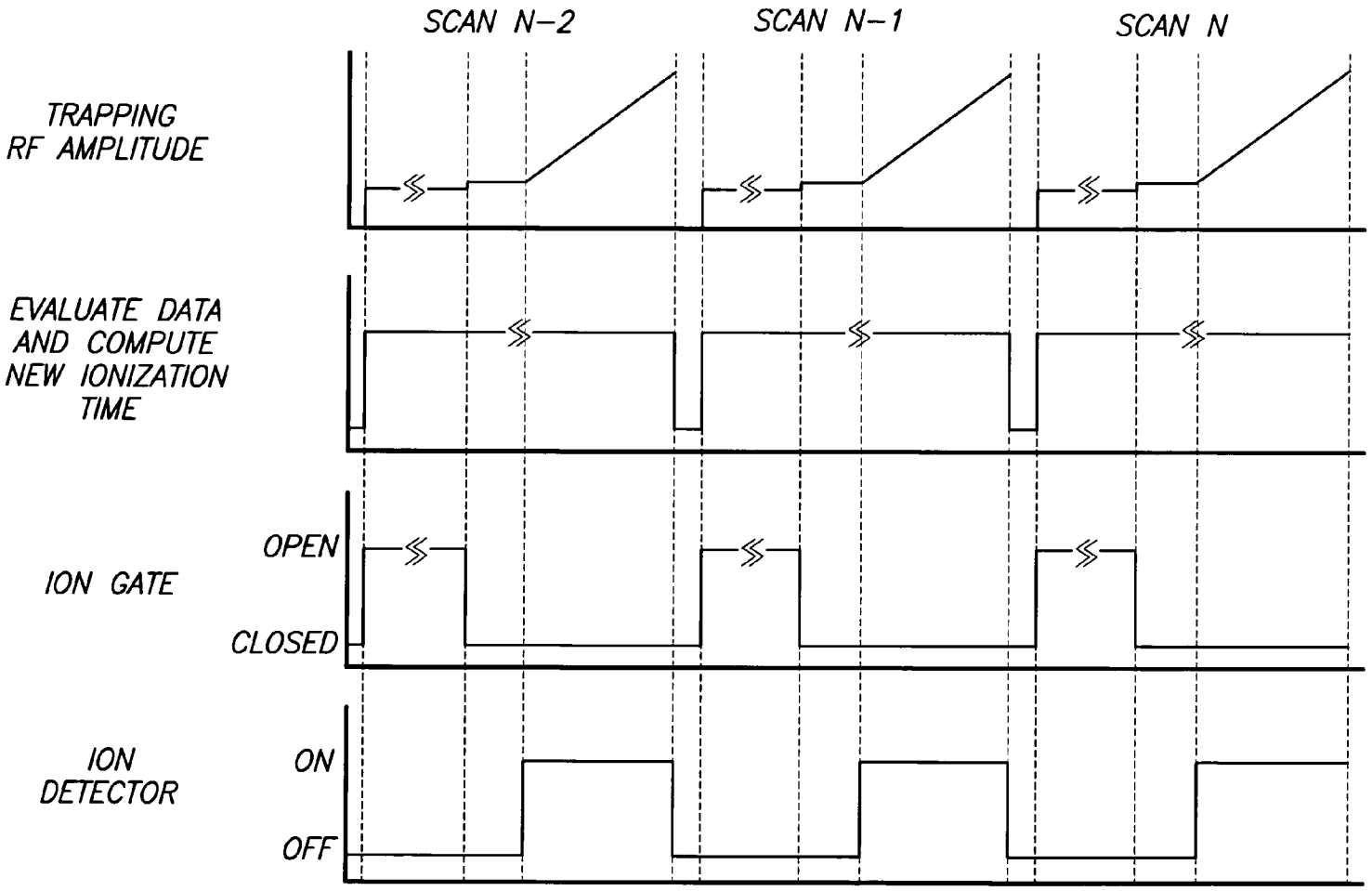

Referring to FIGS. 13 and 14, exemplary processes are provided for determining if parameter sets should be modified and modifying parameter sets when a determination of modification is made. These exemplary processes can be useful at S42, S44, S46, S102, S106, and S108 of FIGS. 9 and 12, for example. Referring to FIG. 13, for example, the process begins with S200 where the total ion current parameter of a data set is acquired and the process proceeds to applying a digital filter to this data set parameter at S202. Exemplary filters include a two pole Butterworth algorithm but other filters and/or no filter can also be used. From there the process proceeds to S204 where a determination is made as to whether the total ion current has exceeded the upper threshold predetermined by the user. Where it has exceeded the upper threshold, an increment of the upper count is made at S206 and the process proceeds to S208.

At S208 a determination is made as to whether or not the total ion current has exceeded the lower threshold. Where the lower threshold has been exceeded, an incremental count of the data points below the lower threshold is made at S210 and the process proceeds to S212.

At S212 a determination is made as to whether or not the total ion current is greater than the maximum predefined by the user. Upon a determination that a maximum is exceeded, the total number of times that the maximum is exceeded is accounted for in S214. The process then proceeds by totaling the incremental upper limit, the incremental lower count and the maximum values in S216.

After S216 the process proceeds to S218 where a determination is made as to whether or not more data points need to be acquired. If more data points do need to be acquired, the process reverts to S200 and more data points are acquired. If not, the process proceeds to S220 in FIG. 14 where the upper count is compared to a predefined limit and if greater, the process proceeds to S222 where the ionization time parameter of the parameter set used to acquire the data set having the total ion current parameter of S200 is decreased. Upon modification of the parameter set the process proceeds to S224 where a determination is made as to whether or not the modified ionization time is less than a minimum ionization time. If the modified time is less than the minimum ionization time, the process proceeds to S226 where a minimum ionization time is set within the modified parameter and then the modified parameter is stored. Where the modified ionization time is greater than the minimum the modified parameter set is stored for use in subsequent analyses.

Referring to S220 where the upper count is less than or equal to the limit, the process proceeds to S228 where a determination is made as to whether the maximum values recorded are greater than the limit. Where the maximum values are greater than the limit, the process proceeds to S222 as described above. Where the maximum value is less than the limit, the process proceeds to S230 where the total value is compared to the total value limit. Where a determination is made that the total is greater than the limit, the process proceeds to S222 as described above. Where it is less than the limit, the process proceeds to S232 for determination of whether the lower count is less than the limit. Where the lower count is less than the limit, the process proceeds to S234 where the ionization time parameter of the parameter set used to acquire the data set is modified to increase the ionization time.

The process then proceeds to S236 where a determination is made as to whether the modified ionization time parameter is greater than the predefined maximum. Where it is greater than the maximum, the process proceeds to S238 where the maximum ionization time parameter is set and the modified parameter is stored. Where it is less than the maximum, the modified set is stored in S240.

Referring again to S232, where it is the case that the lower count limit is greater than the limit, the process proceeds to S242 where the same parameter used to acquire the data set having the total ion current parameter is stored for use in subsequent analyses.

In an exemplary embodiment, after modification of these parameters, the data set parameters acquired using modified parameters can be scaled as described above with reference to FIGS. 9 and 12 to account for the modified parameters. In an exemplary embodiment, the scale factor can be inversely related to parameters such as the ionization time parameter modified and/or utilized during the analysis. In exemplary embodiments, the abundance parameter data can reflect the concentration of sample analyte ions during the analysis. For example, if a long ionization time parameter is used, it can be indicative of a low concentration sample being present and therefore the data can be of low abundance. Where a concentrated sample is present a much shorter ionization time parameter can be used to reach the same threshold and therefore the data can be scaled to reflect a higher abundance.

Referring to FIG. 15, an exemplary depiction of the parameters of the ion source, ion transport gate, and mass analyzer components are shown having different analyses. FIG. 15 can be read in context of FIGS. 9 and 12 with N−2 representing the acquisition two previous to acquisition N, N−1 representing the acquisition one previous to acquisition N and scan N representing the most recent acquisition.

The invention claimed is:

1. A continuous sampling analysis method comprising:

providing gas-phase samples to an analysis component configured as a mass spectrometer;

configuring processing circuitry of the analysis component to acquire data according to a first analysis component parameter set;

using the analysis component configured to acquire data according to the first analysis component parameter set, analyzing an earlier sample to acquire a first data set including analyte ion abundance;

using the processing circuitry, processing the first data set to prepare a second analysis component parameter set, the processing comprising comparing the analyte ion abundance of the first data set to a predefined threshold analyte ion abundance and determining a difference between the analyte ion abundance of the first data set and the predefined threshold;

configuring the processing circuitry of the analysis component to acquire data according to the second analysis component parameter set, the second analysis component parameter set being different from the first analysis component parameter set; and using the analysis component configured to acquire data according to the second analysis component parameter set, analyzing a later sample to acquire a second data set including analyte ion abundance.

2. The method of claim 1 wherein the predefined threshold is a predefined upper limit total ion abundance, and the second analysis component parameter set includes an ionization time parameter less than the ionization time parameter of the first analysis component parameter set.

3. The method of claim 1 wherein the threshold abundance is a lower limit threshold, and the second analysis component parameter set includes an ionization time parameter greater than the ionization time parameter of the first analysis component parameter set.

4. The method of claim 1 further comprising selecting the earlier and/or later samples from a continuous sampling stream.

5. The method of claim 4 wherein the processing of the first data set is performed prior to the selecting of the later sample.

6. The method of claim 1 wherein the samples are part of a stream of gas chromatograph effluent.

7. The method of claim 1 wherein the samples are part of a stream of desorber effluent.

8. The method of claim 1 wherein the second analysis parameter set includes scanning parameters that include predefined m/z ratios.

9. The method of claim 1 wherein the second analysis parameter set includes scanning parameters that include a predefined scan range.

10. The method of claim 1 wherein the second analysis parameter set includes scanning parameters that include a predefined ionization time.

* * * * *